US006729612B2

(12) United States Patent
Nagao et al.

(10) Patent No.: US 6,729,612 B2
(45) Date of Patent: May 4, 2004

(54) IMAGE FORMING AND BINDING SYSTEM AND METHOD

(75) Inventors: Tatsuaki Nagao, Ebina (JP); Yoshihisa Nakaya, Atsugi (JP); Ikoh Miyazawa, Tokyo (JP); Tamaki Kaneko, Fujisawa (JP)

(73) Assignee: Kaneko Co., Ltd., Kanagawa-ken (JP)

( * ) Notice: Subject to any disclaimer, the term of this patent is extended or adjusted under 35 U.S.C. 154(b) by 0 days.

(21) Appl. No.: 10/183,085

(22) Filed: Jun. 27, 2002

(65) Prior Publication Data

US 2003/0057626 A1 Mar. 27, 2003

(30) Foreign Application Priority Data

Sep. 26, 2001 (JP) ..... 2001-292801

(51) Int. Cl.[7] ..... B65H 33/04
(52) U.S. Cl. ..... 270/37; 270/58.08; 399/410
(58) Field of Search ..... 270/58.08, 58.09, 270/58.11, 58.12, 32, 37; 399/407–410; 493/417, 419, 420

(56) References Cited

U.S. PATENT DOCUMENTS 4,406,649 A * 9/1983 Yamamura ..... 493/421
5,768,677 A * 6/1998 Natsume ..... 399/376
5,905,935 A * 5/1999 Wakamatsu et al. ..... 399/407
5,918,101 A * 6/1999 Kuroyanagi ..... 399/407
5,993,369 A * 11/1999 Sekita et al. ..... 493/420

FOREIGN PATENT DOCUMENTS

JP 2002029175 A * 1/2002 ..... B42B/4/00

* cited by examiner

*Primary Examiner*—Christopher P. Ellis
*Assistant Examiner*—Mark A. Deuble
(74) *Attorney, Agent, or Firm*—Cooper & Dunham LLP

(57) ABSTRACT

An image forming and binding system and method for producing a booklet of a document file, in which images of two pages of the document file are formed on each side of a full-size sheet (such as an A3 or B4 size sheet) conveyed in its longitudinal direction and an image of one page of the document file is formed on each side of a half-size sheet half the size of the full-size sheet (such as an A4 or B5 size sheet) conveyed in its lateral direction, and in which the full-size sheet conveyed in its longitudinal direction is folded in two at its center portion in the longitudinal direction thereof and the folded full-size sheet is stacked one upon another to be bound at its folded side edge portion and the half-size sheet conveyed in its lateral direction is conveyed without being folded to be stacked and bound while being mixed with the folded full-size sheet, so that blank pages in the booklet, which are caused when the number of total pages of the document file is not a multiple number of 4, are reduced.

26 Claims, 25 Drawing Sheets

Fig 18B 18-13: send every one seconds the signal indicating that preparation of starting image formation for the second block has been completed 18-3: after completion of jogging of the folded sheet, the binding apparatus 3 is put into the state ready for receiving a next sheet and waiting for receiving a signal, and upon receiving the signal indicating that preparation of starting image formation for the second block has been completed, send the signal indicating that the binding apparatus 3 is in the state ready for receiving a sheet 18-14: Upon receiving the signal indicating that the binding apparatus 3 is in the state ready for receiving a sheet, instruct the printer 2 to form images for the second block [p8, p5 p6, p7] on a next sheet 18-4: receive the sheet carrying the images of the second block [p8, p5, p6, p7], folds the sheet, stacks the folded sheet on the previously conveyed folded sheet and jogs the stacked folded sheet

Fig 18C 18-15: sends every one seconds the signal indicating that preparation of starting image formation for the third block (last block) has been completed 18-5: after completion of jogging of the folded sheet, the binding apparatus 3 is put into the state ready for receiving a next sheet and waiting for receiving a signal, and upon receiving the signal indicating that preparation for forming images for the last block has been completed, send the signal indicating that the binding apparatus 3 is in the state ready for receiving a next sheet 18-16: Upon receiving the signal indicating that the binding apparatus 3 is in the state ready for receiving a sheet, instruct the printer 2 to form images for the last block [p4, p1, p2, p3] on a next sheet 18-6: receive the sheet carrying the images of the last block [p4, p1, p2, p3], and in this example, the received sheet is jammed, the jammed sheet is removed, and the reset button is depressed

IMAGE FORMING AND BINDING SYSTEM AND METHOD

BACKGROUND OF THE INVENTION

1. Field of the Invention

The present invention relates to an image forming and binding system for producing a booklet of a document file, and in particular to an image forming and binding system for producing a booklet of a document file in which images of two pages of the document file are formed on each side of a sheet conveyed in its longitudinal direction, the sheet is folded in two at its center portion in the direction the sheet is conveyed, the folded sheet is stacked one upon another, and the stacked folded sheets are then bound at the folded side edge portions thereof.

2. Discussion of the Background

A binding technology used in producing weekly magazines is well known. After both-sided printed sheets are stacked and jogged, the stacked printed sheets are stapled at their center portions in the longitudinal directions thereof by a stapling device, the stapled sheets are folded at their stapled center portions, and then the side edges of the folded sheets opposite the stapled and folded side of the folded sheets are cut off by a cutting apparatus so as to be uniform.

When the above-described binding technology is used in producing a booklet of a document file, images of four pages of the document file are formed on each printing sheet, images of two pages being formed on each side of the sheet. Further, the images of the first page (the front cover) and the last page (the rear cover) of the document file are formed on the same side of a sheet and the images of the second page and the page before the last page of the document file are formed on the backside of that sheet. Because images of four pages of the document file are formed on one sheet, when the number of total pages of the document file is a multiple number of 4, for example 8, no blank page is produced in the booklet. However, when the number of total pages of the document file is not a multiple number of 4, for example 9 in which a multiple number of 4 (i.e., 8) is added by 1, three blank pages are produced in the booklet. When the number of total pages of the document file is, for example 10 in which a multiple number of 4 (i.e., 8) is added by 2, two blank pages are produced in the booklet.

Also, a binding apparatus connected with a copying machine is known. The binding apparatus is connected with the copying machine downstream of a sheet discharging part of the copying machine in the sheet discharging direction. Sheets each carrying an image on one or both sides thereof, discharged from the copying machine, are stacked and jogged, generally without being folded, and are then stapled at edge portions at one side thereof, at the binding apparatus.

When such a system in which a binding apparatus is connected with a copying machine is used in producing a booklet of a document file, because a folding function to fold each sheet is not generally provided in the binding apparatus, an image for one page of the document file is formed on one side or both sides of a sheet by the copying machine.

In such a system in which a binding apparatus is connected with a copying machine, generally, when a previous sheet conveyed from the copying machine to the binding apparatus is jammed at the binding apparatus, the image formation for a next sheet has been already completed at the copying machine, and thereby the next sheet is also jammed at the same position where the previous sheet has been jammed at the binding apparatus, resulting in jamming of a plurality of sheets.

SUMMARY OF THE INVENTION

The present invention has been made in view of the above-discussed and other problems and addresses the above-discussed and other problems.

Preferred embodiments of the present invention provide a novel image forming and binding system and method for producing a booklet of a document file, in which images of two pages of the document file are formed on each side of a full-size sheet (such as an A3 or B4 size sheet) conveyed in its longitudinal direction and an image of one page of the document file is formed on each side of a half-size sheet half a size of the full-size sheet (such as an A4 or B5 size sheet) conveyed in its lateral direction, and in which the full-size sheet conveyed in its longitudinal direction is folded in two at its center portion in the longitudinal direction thereof and the folded full-size sheet is stacked one upon another to be bound at its folded side edge portion and the half-size sheet conveyed in its lateral direction is conveyed without being folded to be stacked and bound while being mixed with the folded full-size sheet, so that blank pages in the booklet, which are caused when the number of total pages of the document file is not a multiple number of 4, are reduced.

The preferred embodiments of the present invention further provide a novel image forming and binding system and method that avoids jamming of a plurality of sheets from occurring at a binding apparatus of the system, thereby reducing useless image formation at an image forming apparatus of the system.

According to a preferred embodiment of the present invention, an image forming and binding system for producing a booklet of a document file includes an image forming apparatus, an image formation controller and a sheet folding and binding apparatus. The image forming apparatus includes a sheet feeding device configured to feed a full-size sheet set to be conveyed in its longitudinal direction and a half-size sheet half the size of the full-size sheet and set to be conveyed in its lateral direction, and is configured to form images on both sides of the full-size sheet or the half-size sheet fed by the sheet feeding device and to discharge the sheet. The image formation controller is connected with the image forming apparatus and is configured to control the image forming apparatus to form images of the document file on both sides of the full-size sheet and the half-size sheet fed by the sheet feeding device one by one. The image formation controller controls the image forming apparatus to form images of four pages of the document file on each full-size sheet fed by the sheet feeding device such that the images of two pages of the four pages are on each side of the full-size sheet and images of two pages of the document file on each half-size sheet fed by the sheet feeding device such that the image of one page of the two pages is on each side of the half-size sheet. A sheet receiving device of the sheet folding and binding apparatus is configured to receive the sheet discharged from the image forming apparatus and to further convey the received sheet. The sheet receiving device includes a sheet size detect device configured to detect if the received sheet is the full-size sheet conveyed in its longitudinal direction or the half-size sheet conveyed in its lateral direction. A folding device of the sheet folding and binding apparatus is configured to fold the received sheet conveyed by the sheet receiving device in two at its center portion in the direction the received sheet is conveyed by the sheet receiving device, when the received sheet has been detected by the sheet size detect device to be the full-size sheet conveyed in its longitudinal direction, and to further convey the folded received sheet with the folded center portion thereof being served as the leading edge of the folded received sheet. The folding device is further configured to convey the received sheet conveyed by the sheet receiving device without folding the received sheet, when the received sheet has been detected by the sheet size detect device to be the half-size sheet conveyed in its lateral direction. A jogging device of the sheet folding and binding apparatus is configured to receive and jog the received sheet conveyed by the folding device, one after another, so as to be stacked one upon another. A binding device of the sheet folding and binding apparatus is configured to bind the stacked received sheets at their leading edge portions in the direction the received sheets have been conveyed by the folding device and to discharge the bound stacked sheets as the booklet.

In the above-described image forming and binding system, the sheet feeding device of the image forming apparatus may be configured to feed a plurality of full-size sheets different in sizes and set to be conveyed in their longitudinal directions and a plurality of half-size sheets respectively half the sizes of the plurality of full-size sheets and set to be conveyed in their lateral directions. In this case, the image formation controller is configured to designate one of the plurality of full-size sheets as the full-size sheet for forming the images of two pages of the document file on both sides thereof, and the sheet size detect device of the sheet receiving device of the sheet folding and binding apparatus is configured to detect the size of the received sheet. Further, the folding device of the sheet folding and binding apparatus includes a guiding mechanism configured to receive, guide, and stop the received sheet conveyed by the sheet receiving device at a predetermined position according to the size of the received sheet detected by the sheet size detect device, when the received sheet has been detected by the sheet size detect device to be the full-size sheet conveyed in its longitudinal direction. The folding device further includes a sheet pushing mechanism configured to push the received sheet guided and stopped by the guiding device downward at its center portion in the direction the received sheet is conveyed by the sheet receiving device, and a sheet folding/pressing device configured to pinch the received sheet at the center portion thereof pushed by the sheet pushing mechanism so that the received sheet is folded at the center portion thereof by the sheet folding/pressing device and the folded received sheet is further conveyed with the folded center portion thereof being served as the leading edge of the folded received sheet. Furthermore, the sheet pushing mechanism is configured to guide the received sheet conveyed by the sheet receiving device, when the received sheet has been detected by the sheet size detect device to be the half-size sheet conveyed in its lateral direction, so as to be further conveyed by the sheet folding/pressing device without being folded by the sheet folding/pressing device. Further, the jogging device is configured to receive and jog the received sheet conveyed by the folding device, one after another, at a predetermined position in the jogging device according to the size of the received sheet detected by the sheet size detect device, so that the received sheet is stacked one upon another at the predetermined position.

In the immediately above-described image forming and binding system, the sheet receiving device of the sheet folding and binding apparatus may include a correcting mechanism configured to correct an advancing direction of the received sheet so as to be at a right angle relative to a longitudinal direction of the sheet folding/pressing device of the folding device. The correcting mechanism may include a reference guide configured to guide the advancing direction of the received sheet to be at the right angle relative to the longitudinal direction of the sheet folding/pressing device, and a sheet shifting device configured to shift the received sheet, while conveying the received sheet, to the reference guide so that the advancing direction of the received sheet is corrected by the reference guide so as to be at the right angle relative to the longitudinal direction of the sheet folding/pressing device.

In the above-described image forming and binding systems, the jogging device of the sheet holding and binding apparatus may include a movable device configured to move to a predetermined position to jog the received sheet conveyed by the folding device one after another with respect to left and right sides thereof in the direction the received sheet has been conveyed by the folding device, and the sheet folding and binding apparatus may include a controller configured to determine if the movable device has completed its movement to the predetermined position and to generate a signal indicating that the movable device has completed its movement to the predetermined position when determined as that the movable device has completed its movement to the predetermined position. The image formation controller controls the image forming apparatus to start image formation for a next sheet after receiving from the controller of the sheet folding and binding apparatus the signal indicating that the movable device of the jogging device has completed its movement to the predetermined position.

In the above-described image forming and binding systems, the sheet folding and binding apparatus may further include a detect sensor arranged between the folding device and the jogging device to detect passage of the received sheet, and a controller configured to determine that the received sheet has been jammed and to generate a sheet jamming signal indicating that the received sheet has been jammed if detection of the passage of the received sheet by the detect sensor is not started within a predetermined period of time after a leading edge of the received sheet has been detected by the sheet size detect device of the sheet receiving device, or when the detection of the passage of the received sheet by the detect sensor has started, if the detection is not completed within a predetermined period of time after starting the detection. Further, the image formation controller may control the image forming apparatus, when controlling the image forming apparatus to perform an image forming operation after receiving from the controller of the sheet folding and binding apparatus the sheet jamming signal indicating that the received sheet has been jammed, to perform the image forming operation starting with the images of pages of the document file formed immediately before.

Further, in the above-described image forming and binding systems, the sheet folding and binding apparatus may include a controller configured to determine whether or not the folding device, the jogging device and the binding device are respective states ready for receiving a next sheet, and to generate a signal indicating that the folding device, the jogging device and the binding device are in the respective states ready for receiving the next sheet when determined as that the folding device, the jogging device and the binding device are in the respective states ready for receiving the next sheet, and a sheet jamming signal indicating that the received sheet has been jammed when determined as that the folding device, the jogging device and the binding device are not in the respective states ready for receiving the next sheet. In this case, the image formation controller controls the image forming apparatus, when the image forming apparatus is in a state ready for starting an image forming operation, to start the image forming operation upon receiving from the controller of the sheet folding and binding apparatus the signal indicating that the folding device, the jogging device and the binding device are in the respective states ready for receiving the next sheet. Further, the image formation controller may control the image forming apparatus, when controlling the image forming apparatus to perform an image forming operation after receiving from the controller of the sheet folding and binding apparatus the sheet jamming signal indicating that the received sheet has been jammed, to perform the image forming operation starting with the images of pages of the document file formed immediately before.

Furthermore, in the above-described image forming and binding systems, the image formation controller may be configured to control the image forming apparatus to form the images of the document file on the full-size sheet and the half-size sheet that are fed by the sheet feeding device one by one so as to be mixed with each other. The image formation controller may be further configured to control the image forming apparatus to form images of given two pages of the document file on each of a given number of the half-size sheets fed by the feeding device so as to be mixed with the full-size sheet.

Further, in the above-described image forming and binding systems, the image formation controller may be configured to set a direction of forming the images of two pages of the document file on both sides of each full-size sheet to be lateral and a direction of forming the image of one page of the document file on both sides of each half-size sheet to be vertical, and to set upper, bottom, left and right side margins to each half-size sheet and bottom, left and right side margins and a center margin for each full-size sheet.

Furthermore, in the above-described image forming and binding systems, the image forming controller maybe configured to control the image forming apparatus to form the images of four pages of the document file on each full-size sheet such that in order of forming the images at the image forming apparatus, an image of a fourth page of the four pages and an image of a first page of the four pages are on an upper side and an image of a second page of the four pages and an image of a third page of the four pages are on a back side of the full-size sheet, and to form the images of two pages on the half-size sheet such that in order of forming the images at the image forming apparatus an image of a first page of the two pages is on an upper side and an image of a second page of the two pages is on a back side of the half-size sheet.

BRIEF DESCRIPTION OF THE DRAWINGS

A more complete appreciation of the present invention and many of the attendant advantages thereof will be readily obtained as the same becomes better understood by reference to the following detailed description when considered in conjunction with accompanying drawings, wherein:

FIGS. 18A–18E are an explanatory diagram illustrating a communication procedure between the PC and the controller of the sheet folding and binding apparatus.

DETAILED DESCRIPTION OF THE PREFERRED EMBODIMENTS

Figure 1:
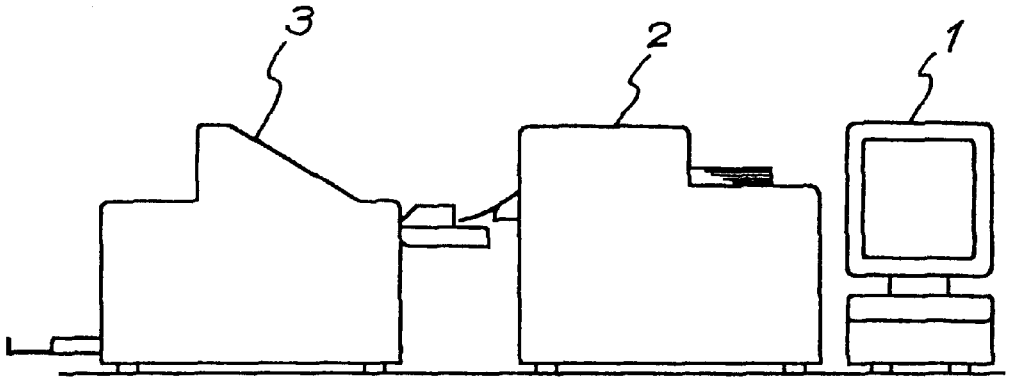
FIG. 1 is a schematic drawing illustrating a configuration of an image forming and binding system for producing a booklet according to an embodiment of the present invention.

Referring now to the drawings, wherein like reference numerals designate identical or corresponding parts throughout the several views, preferred embodiments of the present invention are described.

FIG. 1 is a schematic drawing illustrating an image forming and binding system for producing a booklet of a document file according to an embodiment of the present invention. Numeral 1 denotes a personal computer (PC) as the image formation controller of the present invention, numeral 2 denotes a printer as the image forming apparatus of the present invention, and numeral 3 denotes a binding apparatus as the sheet folding and binding apparatus of the present invention. The sheet folding and binding apparatus folds a sheet in two in the direction the sheet is conveyed, stacks and jogs the folded sheet, one after another, to be stacked one upon another, and then staples the stacked folded sheets.

The PC 1 includes a display, a keyboard for operation, a scanner, etc., and performs generation, editing, processing and reading of image and/or document data of a document, various settings, such as setting of the pages of the document file and the number of booklets to be produced, and displaying of selected modes and states of the system. The PC 1 stores the image and/or document data as a document file, and after storage of the data, performs editing of the data, such as exchanging of the pages of the document file.

The printer 2 as the image forming apparatus includes a sheet feeding device configured to feed full-size sheets different in sizes (e.g., A3 size sheets and B4 size sheets) in their longitudinal directions and half-size sheets half sizes of the full-size sheets (e.g., A4 size sheets and B5 size sheets) in their lateral directions. The printer 2 forms images of image data of the document file sent from the PC 1 on both sides of a sheet fed by the sheet feeding device. The printer 2 forms the images on the sheet for example by an ink jet printing method or by electrophotography.

The printer 2 selects a full-size or half-size sheet of a designated size among from the full-size sheets and the half-size sheets to be fed, according to an instruction from the PC 1. After forming images of two pages of the document file (when the sheet is a full-size sheet) on one side of the fed sheet, the printer 2 reverses the sheet and feeds the reversed sheet again to an image forming part of the printer 2 for forming images of another two pages of the document file on the backside of the sheet. The sheet carrying the images on both sides thereof is discharged from a discharging part of the printer 2.

Figure 2:
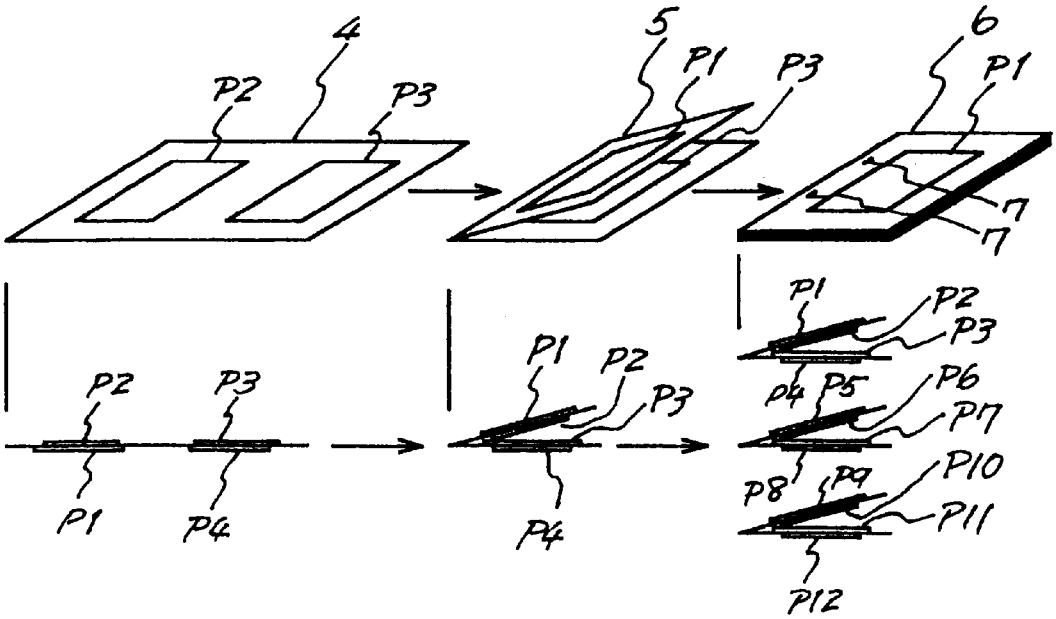
FIG. 2 is a diagram illustrating states that a full-size sheet conveyed in its longitudinal direction is processed by the sheet folding and binding apparatus of the system.

FIG. 2 illustrates states that a full-size sheet conveyed in its longitudinal direction is processed by the binding apparatus 3. A full-size sheet 4 (for example, an A3 or B4 size sheet) discharged from the printer 2 in the longitudinal direction thereof, carrying images of the first and fourth pages of a document file on the backside of the sheet 4 and images of the second and third pages of the document file on the upper side of the sheet 4, as illustrated in the left part of figure, is folded by the binding apparatus 3 in two at the center portion thereof in the direction the sheet 4 is conveyed (i.e., in the longitudinal direction of the sheet 4) to be in a state of a folded sheet 5, as illustrated in the middle part of figure.

When the document file is of 12 pages, for example, first, a sheet 4 conveyed from the printer 2 carrying images of p9, p10, p11, p12 of the document file is folded in two to be a first folded sheet 5. Then, a second sheet 4 conveyed from the printer 2 carrying images of p5, p6, p7, p8 of the document file is folded in two to be a second folded sheet 5, and the second folded sheet 5 is stacked on the first folded sheet 5. Thereafter, a third sheet 4 conveyed from the printer 2 carrying images of p1, p2, p3, p4 of the document file is folded in two to be a third folded sheet 5, and the third folded sheet 5 is stacked on the second folded sheet 5. The stacked folded sheets 5 are then stapled at their folded side edge portions to be discharged as a booklet 6.

In the binding apparatus 3 of this embodiment, a method of stapling the stack of the folded sheets 5 from the upper side thereof is employed, and therefore the image formation at the printer 2 is performed in the order as described above so that the front cover page or the first page of the document file is on the top of the stack of the folded sheets 5. However, when a method of stapling the stack of the folded sheets 5 from the bottom side thereof is used, the image formation at the printer 2 is performed in the reversed order so that the front cover page or the first page of the document file is at the bottom of the stack of the folded sheets 5.

Further, in the image forming and binding system of the present invention, a half-size sheet half the size of the full-size sheet and conveyed in its lateral direction, e.g., an A4 (or B5) size sheet having the same width in the direction the half-size sheet is conveyed as the A3 (or B4) size sheet conveyed in the longitudinal direction thereof and a length the half of the A3 (or B4) size sheet in the direction the half-size sheet is conveyed, can be inserted between the folded full-size sheets 5 of the booklet 6, or before the first or after the last folded full-size sheet 5 of the booklet 6 so as to serve as the front cover page or the first page, or the rear cover page or the last page of the booklet 6.

Figure 3:
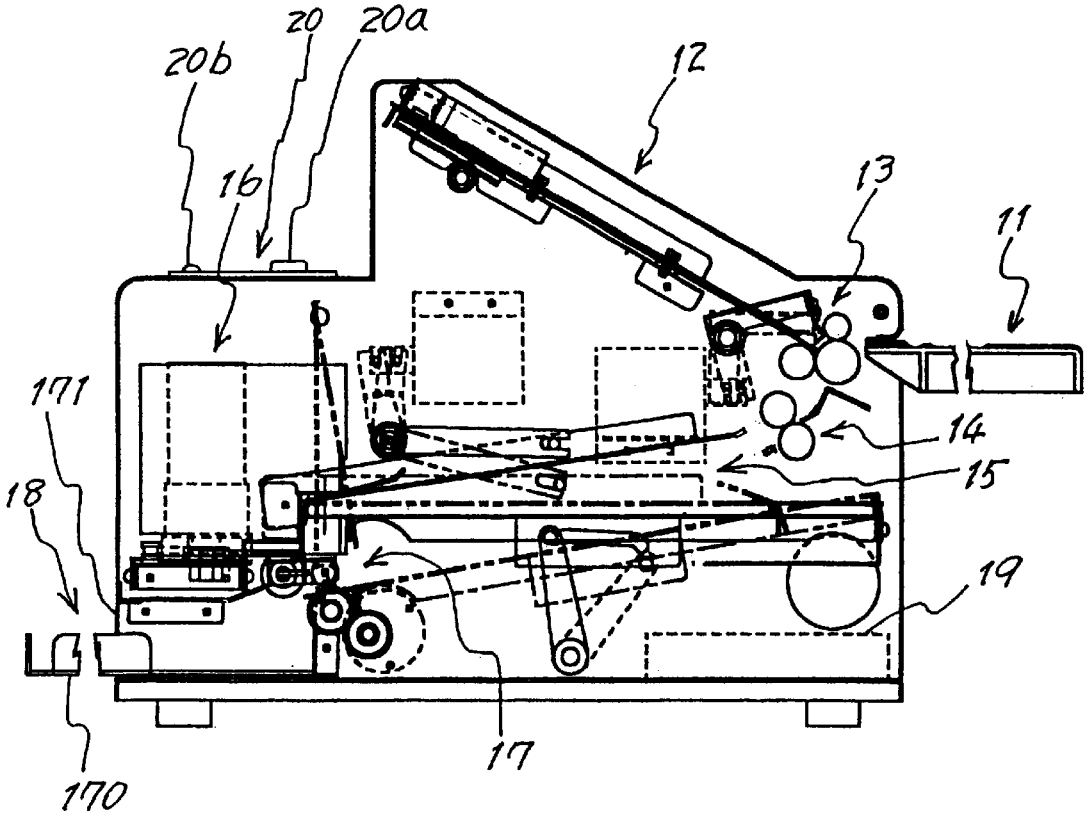
FIG. 3 is a cross section illustrating an exemplary construction of the sheet folding and binding apparatus.

FIG. 3 illustrates an exemplary construction of the binding apparatus 3. The binding apparatus 3 includes, as illustrated in FIG. 3, a sheet receiving part 11, a sheet guiding part 12, a sheet folding part 13, a supplemental pressing part 14, a jogging part 15, a binding part 16, a stack discharging part 17, an exit part 18, a controller 19, and an operation part 20. The sheet guiding part 12 and the sheet folding part 13 constitute a folding device of the present invention.

Figure 4A:
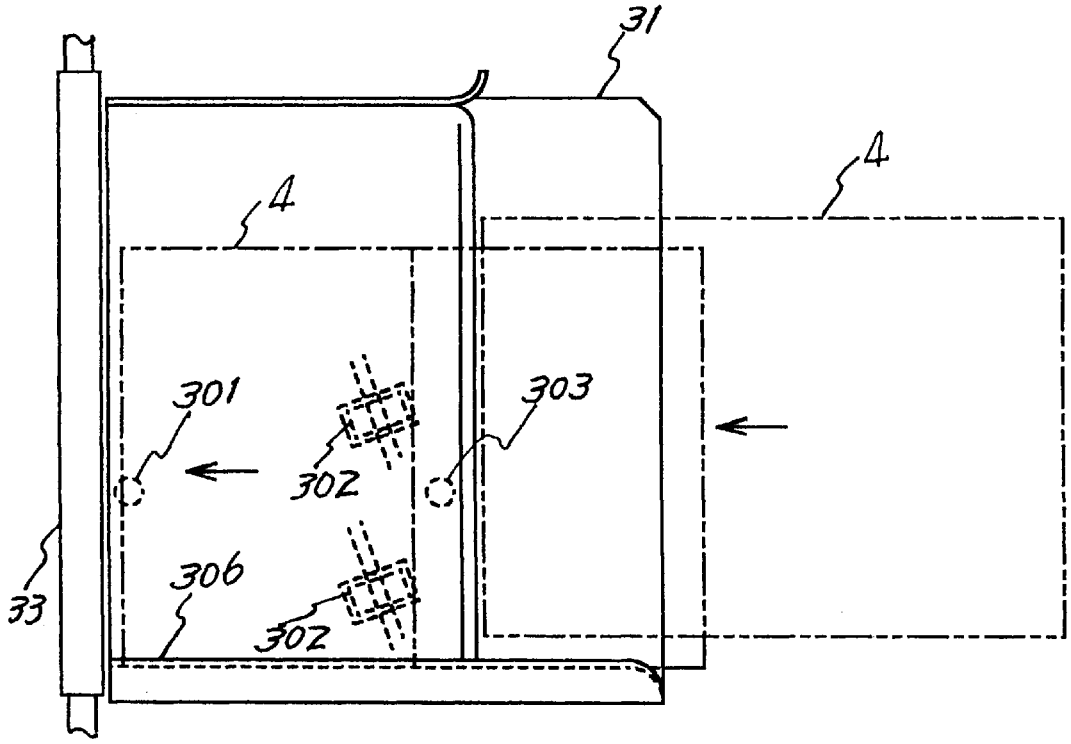
FIGS. 4A and 4B are schematic drawings illustrating an exemplary construction of the sheet receiving part of the sheet folding and binding apparatus.
Figure 4B:
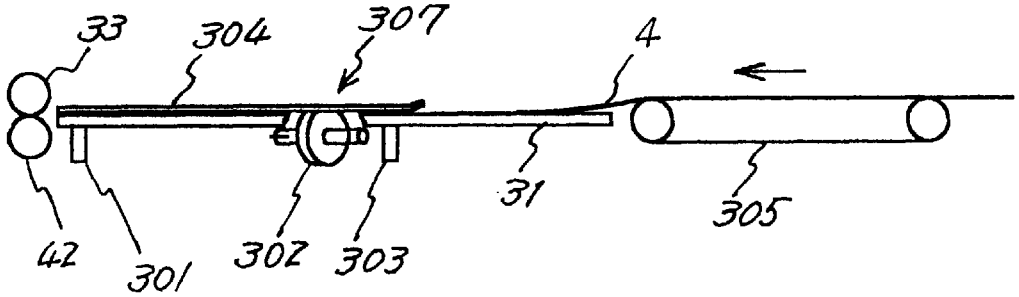

FIGS. 4A and 4B illustrate an exemplary construction of the sheet receiving part 11. The sheet receiving part 11 includes, as illustrated in FIG. 4B, a relaying conveying belt 305, a shifting mechanism 307, an entrance roller 33, and a driving part (not illustrated) of the sheet receiving part 11. The relaying conveying belt 305 receives a sheet 4 discharged from the printer 2 and conveys the sheet 4 to the shifting mechanism 307.

The shifting mechanism 307 includes (see also FIG. 4A) slanting rollers 302, a motor (not illustrated) for rotating the slanting rollers 302, a table 31, an upper guide plate 304, a reference guide 306, and a tip end sensor 303 and an intermediate sensor 301. The reference guide 306 guides the sheet 4 so that the advancing direction of the sheet 4 is perpendicular to a sheet folding roller pair 42 of the sheet folding part 13 (described later). Thereby, when the sheet 4 is a full-size sheet conveyed in its longitudinal direction, the sheet 4 is folded by the sheet folding roller pair 42 at a right angle relative to the direction the sheet 4 is conveyed. The upper guide plate 304 is provided with a gap formed between the upper guide plate 304 and the table 31. When the sheet 4 is conveyed into this gap and is detected by the tip end sensor 303, the motor for the shifting mechanism and an entrance motor 21 (FIG. 5) start to rotate, and the slanting rollers 302 rotate while slightly pressing the sheet 4 against the upper guide 304. Because the slanting rollers 302 are arranged slantingly as illustrated in FIGS. 4A and 4B, the sheet 4 between the slanting rollers 302 and the upper guide 304 is conveyed slantingly to be shifted toward the reference guide 306, so that the sheet 4 is conveyed along the reference guide 306. The rollers of the slanting rollers 302 are made of elastic material, so that the sheet 4 is advanced along the reference guide 306 without being forcedly pushed against the reference guide 306. The sheet 4 passes the intermediate sensor 301 and is conveyed into between the entrance roller 33 and the sheet folding roller pair 42.

The tip end sensor 303 and the intermediate sensor 301 are arranged such that the distance between the tip end sensor 303 and the intermediate sensor 301 is longer than the half of the length of the A3 size sheet as an example of a full-size sheet conveyed in its longitudinal direction by about 20 mm. Thereby, when the sheet 4 is the half-size sheet of the A3 size sheet, i.e., the A4 size sheet, conveyed in its lateral direction, because the width of the A4 size sheet 4 in the direction the sheet 4 is conveyed is the same as that of the A3 size sheet conveyed in the longitudinal direction thereof and the length in the direction the sheet 4 is conveyed is equal to the half of that of the A3 size sheet conveyed in the longitudinal direction thereof, the A4 size sheet 4 conveyed in its lateral direction is not detected at the same time by both of the tip end sensor 303 and the intermediate sensor 301. That is, when a sheet 4 is detected by the tip end sensor 303 and the intermediate sensor 301 at the same time, the sheet 4 is an A3 full-size sheet conveyed in its longitudinal direction, and when the sheet 4 is not detected by the tip end sensor 303 and the intermediate sensor 301 at the same time, the sheet 4 is a half-size sheet of the A3 full-size sheet, i.e., an A4 size sheet, conveyed in its lateral direction. Thus, whether the conveyed sheet 4 is the A3 full-size sheet conveyed in its longitudinal direction or the half-size sheet of the A3 full-size sheet, i.e., the A4 size sheet, conveyed in its lateral direction, is determined by the controller 19 based upon the detect result of the tip end sensor 303 and the intermediate sensor 301. For detecting if the conveyed sheet 4 is a B4 full-size sheet conveyed in its longitudinal direction or a half-size sheet of the B4 full-size sheet, i.e., a B5 size sheet, conveyed in its lateral direction, another sensors can be similarly arranged. The tip end sensor 303 and the intermediate sensor 301 for detecting if the conveyed sheet 4 is the A3 full-size sheet conveyed in its longitudinal direction or the half-size sheet of the A3 full-size sheet conveyed in its lateral direction, the sensors for detecting if the conveyed sheet 4 is the B4 full-size sheet conveyed in its longitudinal direction or the half-size sheet of the B4 full-size sheet conveyed in its lateral direction, and the controller 19 constitute a sheet size detect device of the present invention.

Figure 5:
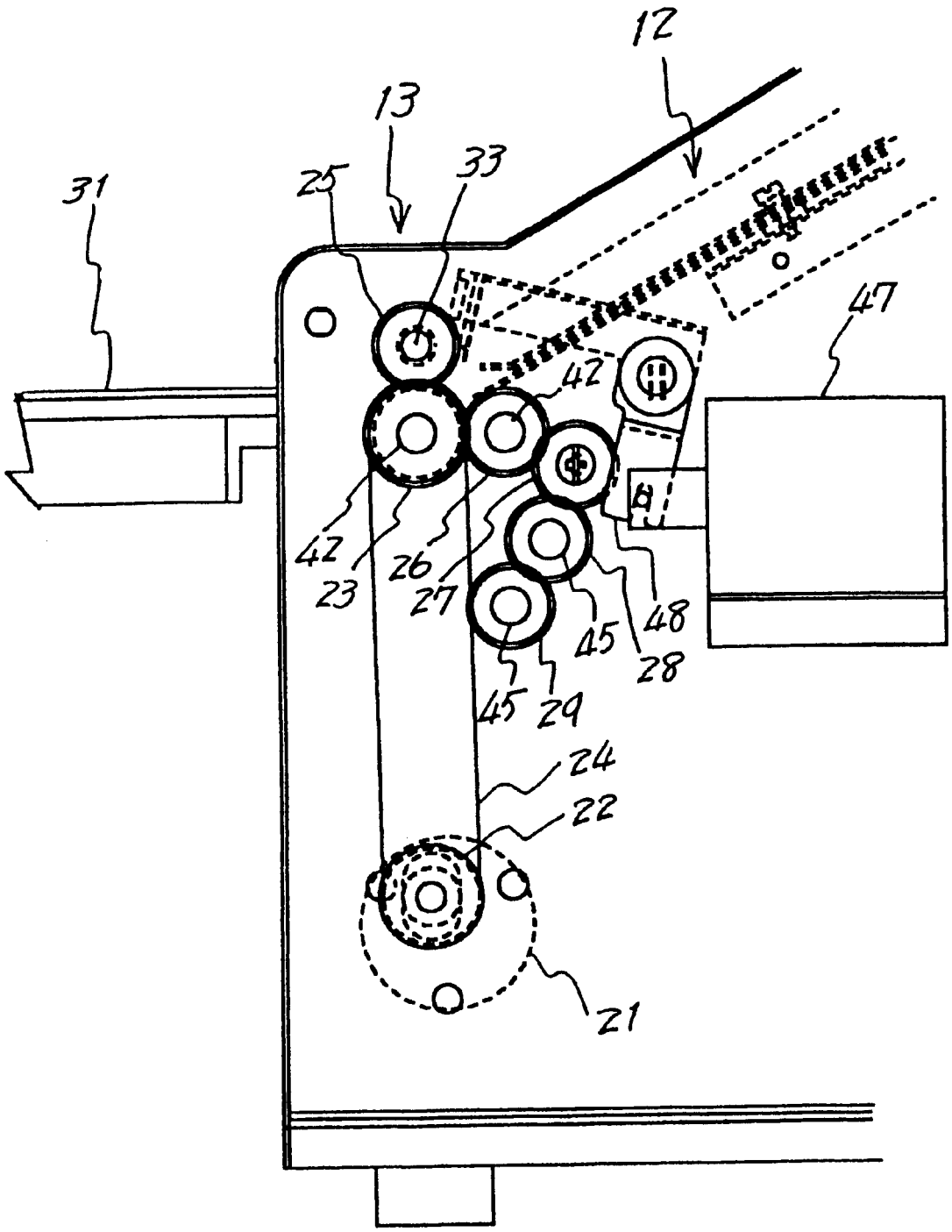
FIG. 5 is a cross section illustrating an exemplary driving mechanism of the sheet folding part and the supplemental pressing roller pair of the supplemental pressing part of the sheet folding and binding apparatus.

FIG. 5 is a drawing illustrating an exemplary driving mechanism for the sheet folding part 13 and the supplemental pressing roller pair 45 of the supplemental pressing part 14. As illustrated in FIG. 5, the entrance roller 33 is provided on the sheet folding roller pair 42 with a predetermined pressure applied thereto. A gear 25 is provided on the axis of the entrance roller 33 at the position outside of a side plate of the binding apparatus 3, and the gear 25 engages with a pulley gear 23 fixed to the sheet folding roller pair 42. The pulley gear 23 engages with a gear 26, which engages via an idle gear 27 with a gear 28 and a gear 29 fixed to the supplemental pressing roller pair 45. A pulley 22 fixed to the entrance motor 21 and the pulley gear 23 are connected with each other by a belt 24. When the entrance motor 21 rotates, the entrance roller 33, the sheet folding roller pair 42 and the supplemental pressing roller pair 45 rotate at the same time. Thus, the entrance roller 33 and the sheet folding roller pair 42 rotate at the same circumferential speed to convey a sheet 4 conveyed thereto from the sheet receiving part 11 to the sheet guiding part 12.

Figure 6:
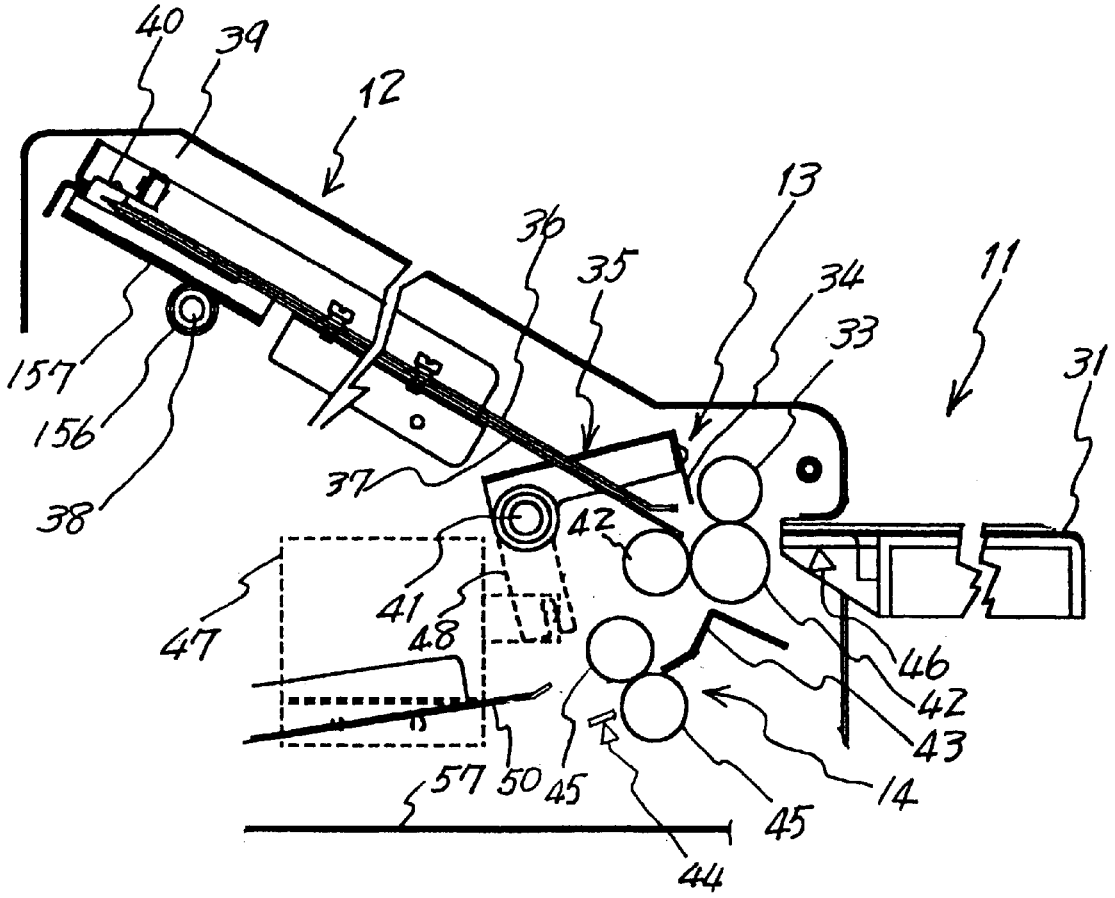
FIG. 6 is a cross section illustrating the sheet receiving part, the sheet guiding part, the sheet folding part, and the supplemental pressing part of the sheet folding and binding apparatus.

FIG. 6 is a cross section illustrating the sheet receiving part 11, the sheet guiding part 12, the sheet folding part 13, and the supplemental pressing part 14.

The sheet guiding part 12 includes, as illustrated in FIG. 6, an upper guide plate 36, a lower guide plate 37, a sheet stopper 40, and a sheet leading edge sensor 39. The upper guide plate 36 and the lower guide plate 37 are spaced from each other so that the sheet 4 conveyed by the entrance roller 33 slides into between the upper guide plate 36 and the lower guide plate 37. A window is provided in the upper guide plate 36 and the lower guide plate 37, and the sheet stopper 40 is arranged so as to slidably engage with the window to stop the sheet 4. The sheet leading edge sensor 39 is arranged in front of the sheet stopper 40 in the sheet conveying direction.

An adjusting rack 157 is fixed to the sheet stopper 40, and an adjusting pinion 156 fixed to an adjusting axis 38 engages with the adjusting rack 157. With rotation of the adjusting axis 38, the adjusting rack 157 moves, so that the sheet stopper 40 slidably moves along the window of the upper guide plate 36 and the lower guide plate 37.

Figure 7:
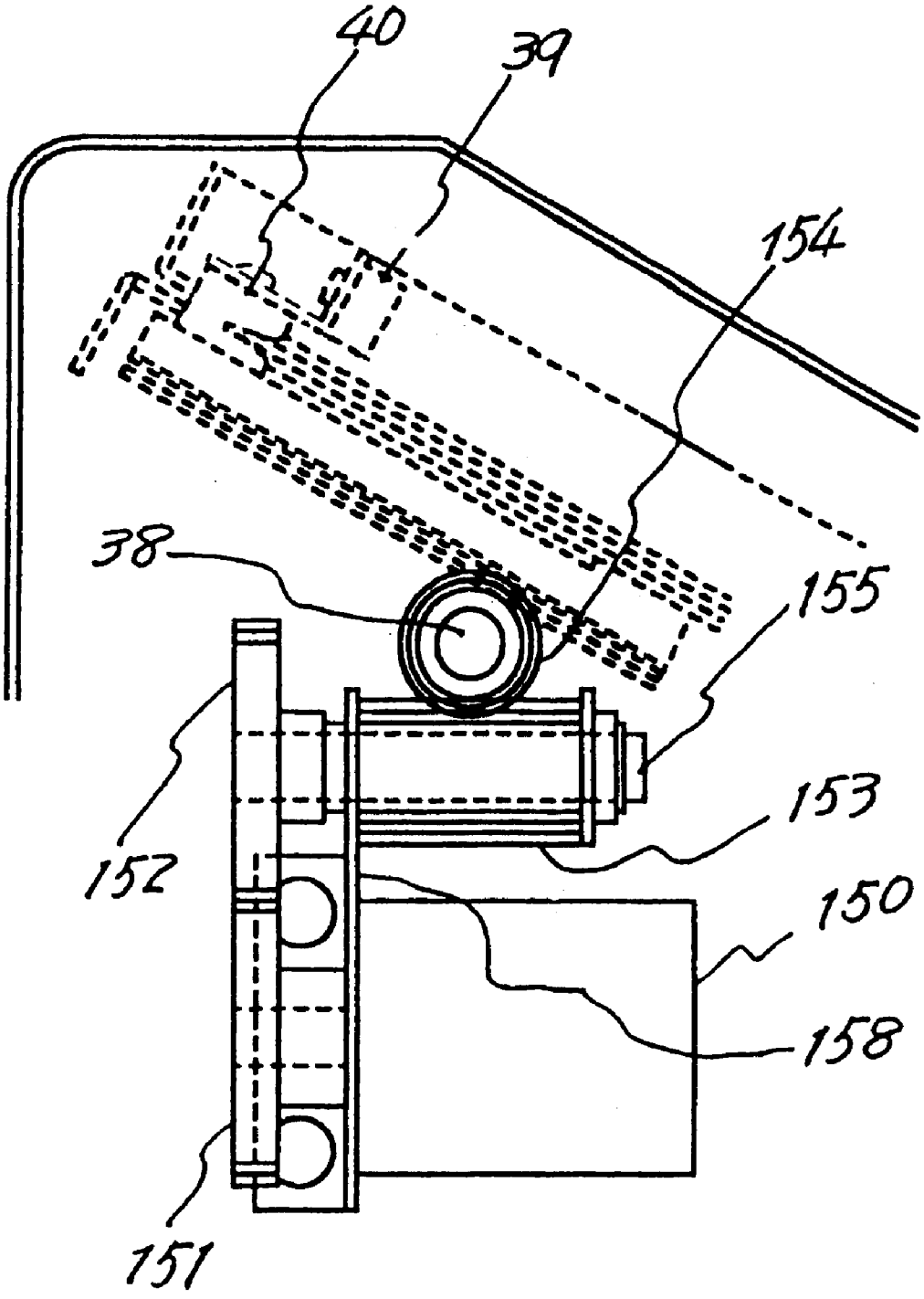
FIG. 7 is a schematic drawing illustrating an exemplary mechanism of changing the position of the sheet stopper of the sheet guiding part.

Referring now to FIG. 7, when the sheet 4 has been detected to be the full-size sheet by the sheet size detect device of the sheet receiving part 12, the positions of the sheet stopper 40 and the sheet leading edge sensor 39 are changed by an adjusting motor 150 according to the size of the full-size sheet 4 (such as the A3 or B4 size), which is also detected by the sheet size detect device of the sheet receiving part 12 as described above. The adjusting axis 38 is rotatably mounted to both side plates of the main body of the binding apparatus 3, and an adjusting worm gear 154 is fixed to a part thereof outside of the side plate of the main body to be engaged with an adjusting worm 153.

The adjusting worm 153 is fixed to an adjusting axis 155, and is rotatably supported by a motor mounting table 158 via a bearing. An adjusting gear 152 is fixed to one end of the adjusting gear 155, and the adjusting gear 152 engages with an adjusting gear 151 fixed to an axis of the adjusting motor 150 fixed to the motor mounting table 158. With rotation of the adjusting motor 150, the adjusting axis 38 rotates, so that the sheet stopper 40 and the sheet leading edge sensor 39 move.

When the full-size sheet 4, which has been slid into between the upper guide plate 36 and the lower guide plate 37, is stopped by the sheet stopper 40, the sheet 4 slackens downwardly toward the sheet folding roller pair 42, substantially at a center portion thereof in the direction the sheet 4 is conveyed, which is out of the upper guide plate 36 and the lower guide plate 37. The slackened center portion of the sheet 4 is pinched by the sheet folding roller pair 42 to be put into between the sheet folding roller pair 42, so that the sheet 4 is folded in two by the sheet folding roller pair 42 at the center portion of the sheet 4 in the direction the sheet 4 is conveyed. The sheet folding roller pair 42 constitutes a sheet folding/pressing device of the present invention.

Figure 8:
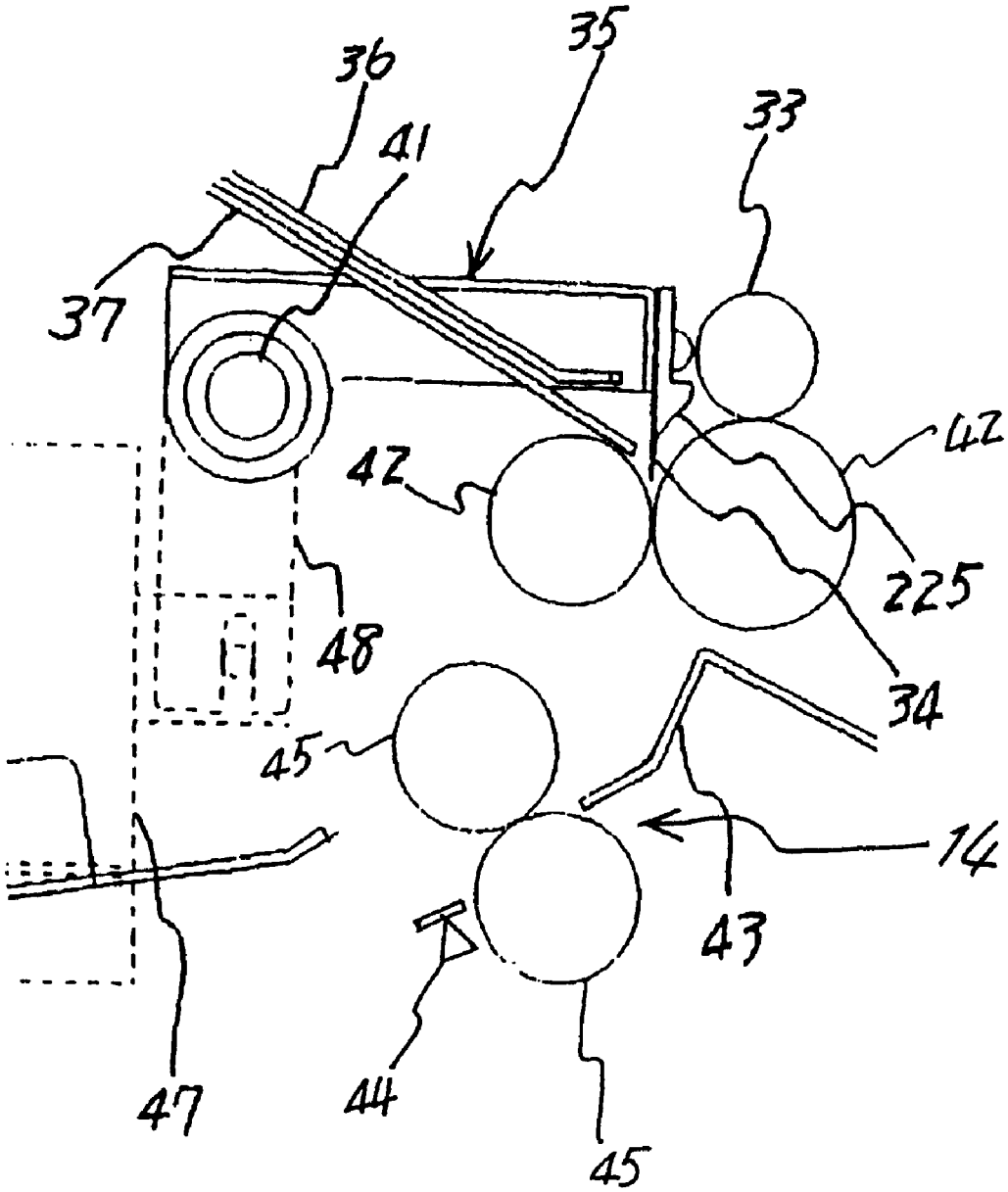
FIG. 8 is a schematic drawing illustrating an exemplary construction of the guiding device for guiding a half-size sheet half a size of the full-size sheet, conveyed in its lateral direction, so as to be conveyed without being folded toward the jogging part of the sheet folding and binding apparatus.

The sheet folding part 13 includes, as illustrated in FIG. 5, the sheet folding roller pair 42 which is driven by the entrance motor 21 at the same circumferential speed as that of the supplemental pressing roller 45 as described above. The sheet folding part 13 further includes as illustrated in FIG. 6 an axis 41 freely rotatable relative to the side plate of the main body, a knife unit 35, a solenoid 47 attached to the outside surface of the side plate, and an arm 48 which is connected with the solenoid 47 to rotate the axis 41. A knife 34 is attached to the knife unit 35, and further a sheet conveying guide 225 (see FIG. 8) is attached to the knife 34 for guiding a sheet 4, when the sheet 4 is a half-size sheet, into between the sheet folding roller pair 42. The knife unit 35 including the knife 34, the solenoid 47, the axis 41 and the arm 48 constitute a sheet pushing mechanism of the present invention.

The full-size sheet 4 which has been slid into between the upper guide plate 36 and the lower guide plate 37 can be folded by the sheet folding roller pair 42 at the center portion thereof in the direction the full-size sheet 4 is conveyed without the knife unit 35 having the knife 34. However, by use of the knife unit 35, the full-size sheet 4 can be more reliably folded at the center portion thereof by the sheet folding roller pair 42.

When using the knife unit 35, after the sheet leading edge sensor 39 detects a leading edge of the sheet 4, at a predetermined timing the solenoid 47 operates so as to rotate the knife unit 35 around the axis 41 in the clockwise direction. Thereby, the sheet 4 is pushed by the knife 34 of the knife unit 35 at the slackened center portion thereof downwardly toward the sheet folding roller pair 42, so that the pushed slackened center portion of the sheet 4 is reliably pinched by the sheet folding roller pair 42.

Once the slackened and pushed center portion of the sheet 4 is pinched by and put into the sheet folding roller pair 42, the solenoid 47 is turned off, and at the same time the knife unit 35 is released to return to the upper position illustrated in FIG. 6.

When a half-size sheet of the A3 full-size size sheet, i.e., an A4 size sheet, conveyed in its lateral direction, is received as the sheet 4, as described above, at the sheet receiving part 11, the leading edge sensor 303 does not detect the sheet 4 at the same time when the intermediate sensor 301 detects the sheet 4, and thereby it is determined as that the sheet 4 is the half-size sheet of the A3 full-size sheet, i.e., the A4 size sheet, conveyed in its lateral direction. At that time, the solenoid 47 is operated so that the knife unit 35 is moved to the lower position illustrated in FIG. 8. Thereby, the half-size sheet 4 is guided by the conveying guide 225 attached to the knife 34 of the knife unit 35 so as to be conveyed into the sheet folding roller pair 42 without being conveyed to the sheet guiding part 12. Thus, the half-size sheet 4 is conveyed by the sheet folding roller pair 42 to the jogging part 14 without being folded.

When the knife unit 35 is not used, the half-size sheet 4 (such as the A4 or B5 size sheet) conveyed in the lateral direction is conveyed into between the lower guide plate 37 and the upper guide plate 36. The half-sized sheet 4 is discharged from the entrance roller 33, and is then stopped by the sheet stopper 40 with the trailing end of the half-size sheet 4 being protruded out of the lower guide plate 37 and the upper guide plate 36. When the knife unit 35 is not used, therefore, for conveying the half-size sheet 4 conveyed into between the lower guide plate 37 and the upper guide plate 36 into the sheet folding roller pair 42 so as to be conveyed to the jogging part 15, a returning roller 210 is provided as illustrated in FIG. 9.

Figure 9:
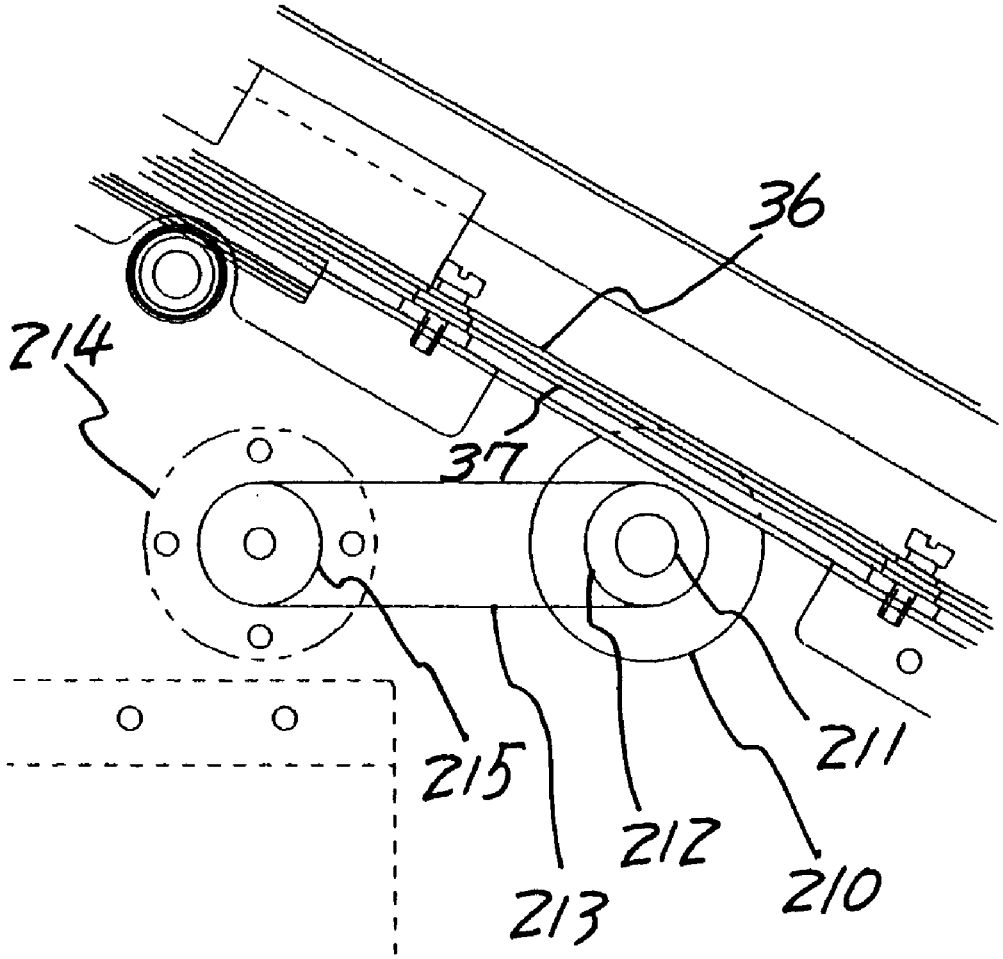
FIG. 9 is a schematic drawing illustrating a returning device for returning the half-size sheet guided to the sheet guiding part to be conveyed, without being folded, toward the jogging part.

In FIG. 9, the returning roller 210 made of, for example, foamed polyurethane or fur brush, is arranged so as to lightly contact the upper guide plate 36 through the window of the lower guide plate 37. The returning roller 210 is configured to give a light returning force for returning the sheet 4 to the sheet 4 when the sheet 4 is conveyed into between the upper guide plate 36 and the returning roller 210.

The returning roller 210 is rotatably supported by the side plates of the main body, and when the sheet 4 is conveyed to the sheet guiding part 12, rotation of a returning motor 214 fixed to the side plates is transmitted to the returning roller 210 by a belt 213 spanned around a pulley 212 integrated with the returning roller 210 and a pulley 215 directly connected with the returning motor 214, so that the returning roller 210 is rotated. However, the returning roller 210 is configured such that when the sheet 4 is being conveyed into between the lower guide plate 37 and the lower guide plate 36, although the returning roller 210 rotates in the direction to return the sheet 4 being conveyed into between the lower guide plate 37 and the upper guide plate 36, the returning roller 210 only slips on the sheet 4. Thus, the returning roller 210 returns the sheet 4 only when the sheet 4 is not being conveyed, so that when the sheet 4 is a full-size sheet conveyed in its longitudinal direction, folding of the full-size sheet 4 is not affected.

When the knife unit 35 is not used and the returning roller 210 is provided for conveying the half-size sheet 4 to the jogging part 15 as described above, the received hall-size sheet 4 is conveyed to the jogging part 15 with the surfaces thereof turned upside down.

Figure 10:
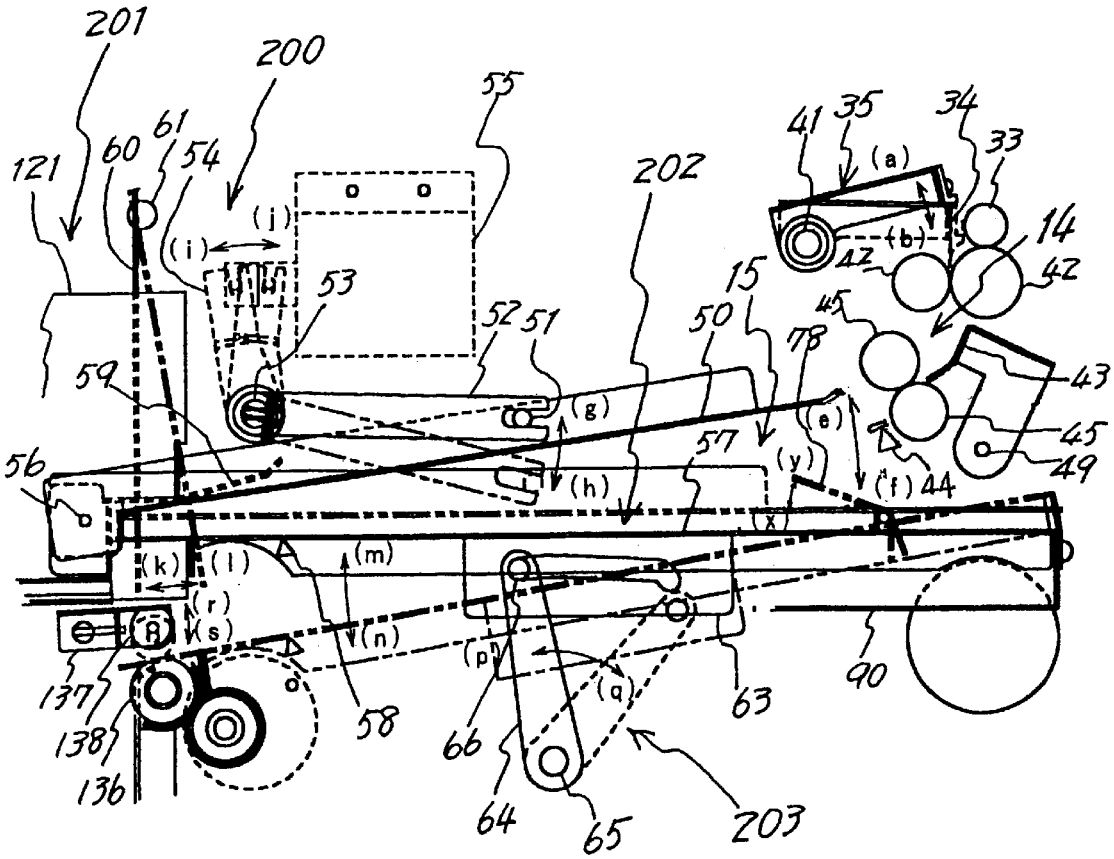
FIG. 10 is a cross section illustrating an exemplary construction of the supplemental pressing part and the jogging part of the sheet folding and binding apparatus.

FIG. 10 is a cross section illustrating an exemplary construction of the supplemental pressing part 14 and the jogging part 15.

The supplemental pressing part 14 includes as illustrated in FIG. 10 the supplemental pressing roller pair 45, an intermediate guide plate 43, a sheet sensor 44, and a supporting axis 49 around which the intermediate guide plate 43 rotates in the clockwise direction. When the sheet 4 conveyed by the sheet folding roller pair 42 is jammed at the supplemental pressing part 14, for removing the jammed sheet 4, the intermediate guide plate 43 is rotated around the axis 49 in the clockwise direction. The supplemental pressing roller pair 45 presses the folded portion of a folded sheet 5 conveyed by the sheet folding roller pair 42 with the folded portion of the folded sheet 5 as the leading edge thereof, so as to be further firmly folded, and conveys the folded sheet 5 toward the jogging part 15 to be discharged onto a jogging table 57 of the jogging part 15. The sheet sensor 44 detects passage of the folded sheet 5 to the jogging part 15.

The jogging part 15 includes, as illustrated in FIG. 10, a sheet center thrusting mechanism 200 which thrusts the folded full-size sheet 5 or the half-size sheet 4 discharged from the sheet folding part 13 onto the jogging table 57 from above, a stapling position determining mechanism 201 which makes uniform the leading edges of the folded full-size sheets 5 and the half-size sheets 4 on the jogging table 57 in the directions the folded full-size sheets 5 and the half-size sheets 4 have been conveyed, a jogging table part 202, and a jogging table upward/downward moving mechanism 203.

The sheet center thrusting mechanism 200 includes a sheet center thrusting plate 50, an axis 56 around which the sheet center thrusting plate 50 swings, an upper guide 59 which guides from above both sides of the leading edge of the folded full-size sheet 5 or the half-size sheet 4, an axis 51 which is integrally mounted to the sheet center thrusting plate 50, an arm 52 which transmits a swinging force to the sheet center thrusting plate 50 to swing the sheet center thrusting plate 50, an axis 53 which is rotatably mounted to the side plate of the main body and around which the arm 52 rotates, a solenoid 55 which performs the swinging operation of the sheet center thrusting plate 50, and an arm 54 which transmits a force of the solenoid 55 to the arm 52 as a rotation movement. The arm 52, the axis 53, and the arm 54 are integrated with each other.

The stapling position determining mechanism 201 determines the position where a position determining plate 60 stops to determine the position where a stapler 121 of the binding part 16 staples a stack of the folded full-size sheets 5 and the half-size sheets 4 at the leading edge portions thereof. Further, the stapling position determining mechanism 201 pushes back the stapled stack of the folded full-size sheets 5 and the half-size sheet 4 from the position where the stack of the folded full-size sheets 5 and the half-size sheets 4 has been stapled.

Figure 11:
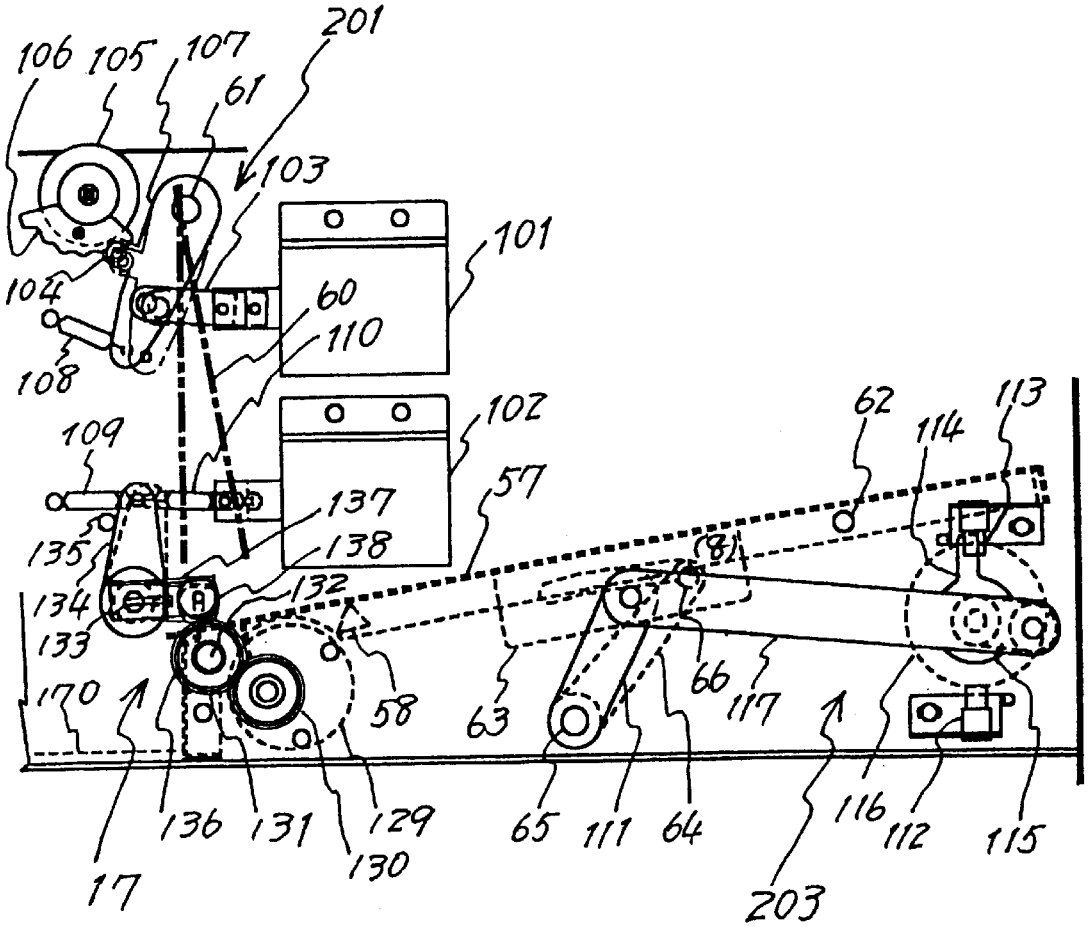
FIG. 11 is a cross section illustrating the stapling position determining mechanism, the jogging table upward/downward moving mechanism, and the stack discharging part of the sheet folding and binding apparatus.

FIG. 11 is a cross section illustrating the stapling position determining mechanism 210, the jogging table upward/downward moving mechanism 203, and the stack discharging part 17.

In FIG. 11, the position determining plate 60 stops a folded full-size sheet 5 or half-size sheet 4 (not illustrated) being conveyed over the jogging table 57 at a leading edge thereof. An axis 61, to which the position determining plate 60 is fixed, is rotatably mounted to the side plate of the main body, and an arm 107 is fixed to the axis 61 at the outside of the side plate. A spring 108 is mounted to the tip end of the arm 107. The spring 108 always pulls the arm 107 in the clockwise direction, so that a roller 104, mounted to the arm 107, is pressed against a cam plate 106, which is fixed to a stapling position adjusting knob 105. The stapling position adjusting knob 105 is mounted to the side plate of the main body, and the operation thereof is regulated by a spring (not illustrated) so as to be rotatable only by a manual operation thereof.

The cam plate 106 fixed to the stapling position adjusting knob 105 engages with the roller 104 of the arm 107. The grooves of the cam plate 106 are formed such that the heights of the grooves change in several steps, and thereby the position of the position determining plate 60 to stop is adjusted according to the position where the stapling position adjusting knob 105 stops rotating.

The arm 107 rotatably supports a link 103 at one end thereof, and the other end of the link 103 is connected with a solenoid 101. With the operation of the solenoid 101, the arm 107 connected with the link 103 rotates in the counterclockwise direction. Thereby, the position determining plate 60 fixed to the axis 61 of the arm 107 swings in the counterclockwise direction in FIG. 11, so that a stapled stack 6 of folded full-size sheets 5 and half-size sheets 4 on the jogging table 57 is pushed back toward right in FIG. 11.

Figure 12:
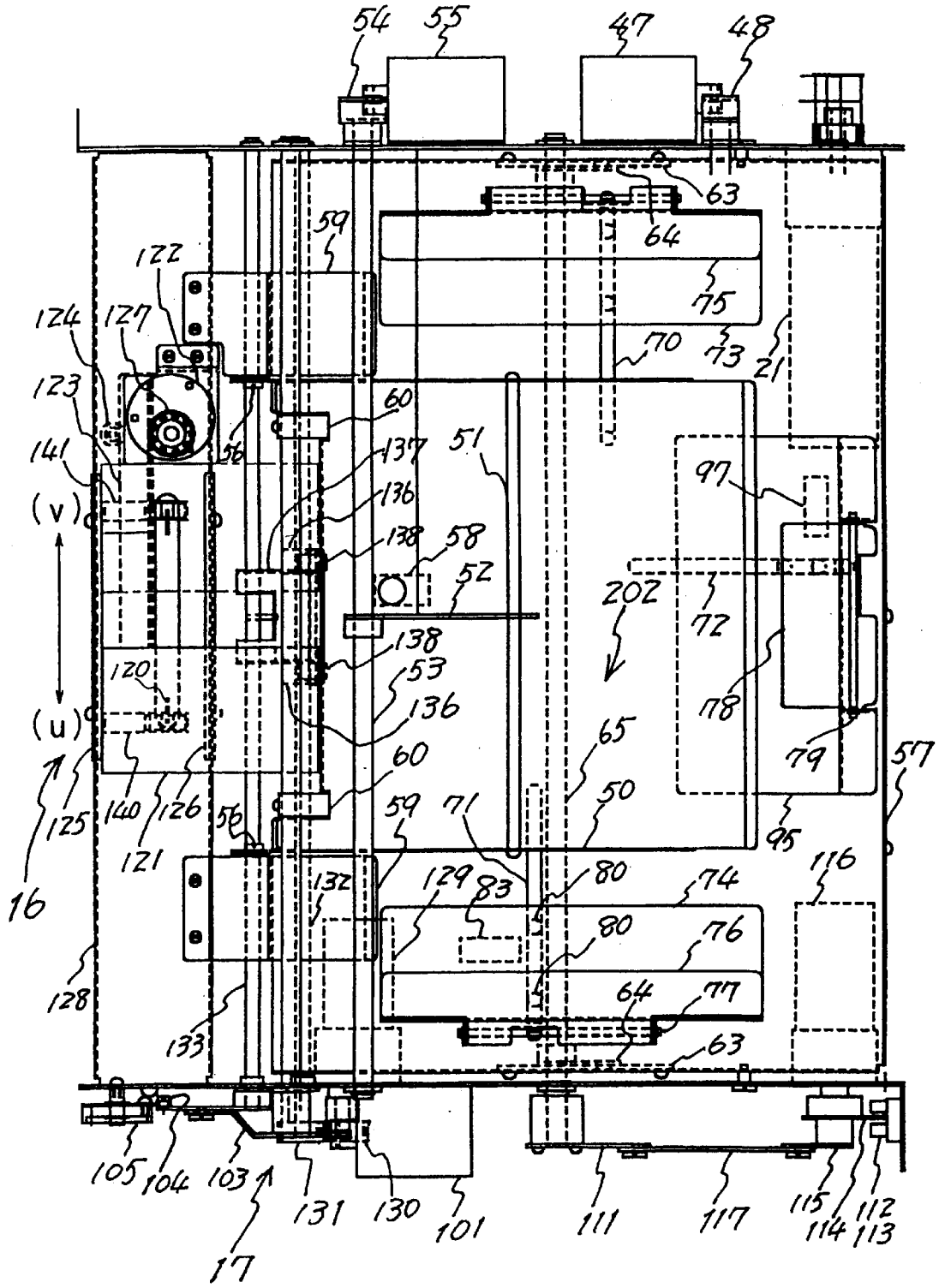
FIG. 12 is a plan view of the jogging table part of the jogging part.
Figure 13:
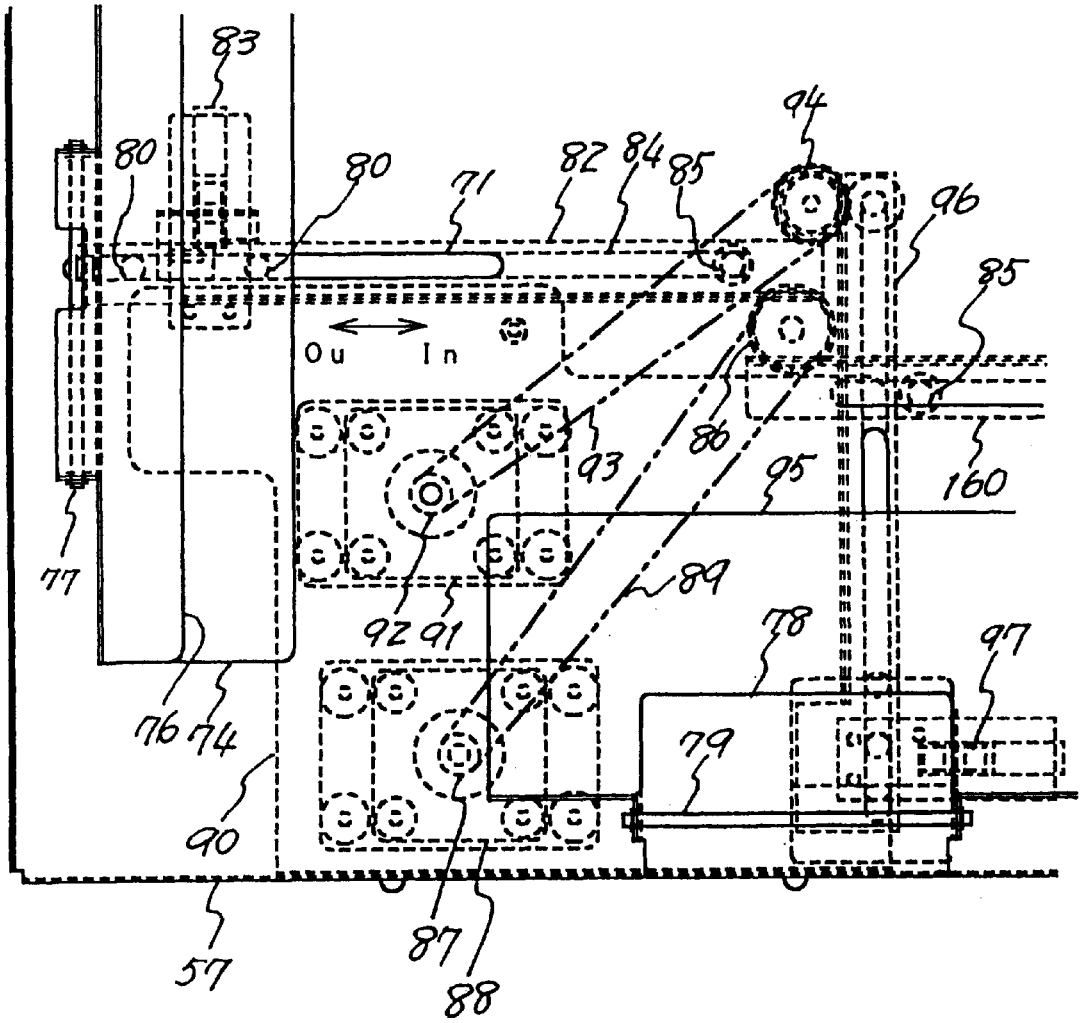
FIG. 13 is a plan view of a part of the jogging table part for explaining a jogging operation.

FIG. 12 is a plan view of the jogging table part 202 of the jogging part 15, and FIG. 13 is a plan view of a part of the jogging table part 202 for explaining a jogging operation.

The jogging table part 202 includes a sensor 58 (see also FIG. 10) mounted to the jogging table 57 to detect existence of a sheet on the jogging table 57, and a left side jogging plate 74 for jogging the sheet with respect to the left side of the sheet in the sheet advancing direction. As illustrated in FIG. 12 and FIG. 13, a jogging plate pin 80 is fixed to the left side jogging plate 74 and is engaged with a jogging table guiding groove 71 formed in the jogging table 57 so as to slidably move in the jogging table guiding groove 71. As illustrated in FIG. 13, a jogging plate rack 82 is attached to the jogging plate pin 80 at the opposite side of the left side jogging plate 74 (i.e., the rear side of the jogging table 57). The jogging plate rack 82 is moved by a pulley 86 which is rotated by a motor 88 attached to a rear plate 90 of the jogging table 57 via a pulley 87 directly connected with the motor 88 and a belt 89.

Further, the jogging table part 202 includes as illustrated in FIG. 13 a right side jogging plate rack 160 which is moved by a pinion integrated with the pulley 86. A right side jogging plate 73 is attached to the right side jogging plate rack 160 via the jogging plate pin 80 in substantially the same manner as in the jogging plate rack 82. The right side jogging plate 73 is in the symmetrical position relative to the left side jogging plate 74 with respect to the sheet on the jogging table. The right side jogging plate 73 and the left side jogging plate 74 operate in a symmetrical manner. The right side jogging plate 73 and the left side jogging plate 74 constitute a movable device of the present invention to move to a predetermined position to jog each folded full-size sheet 5 or half-size sheet 4 with respect to left and right sides thereof in the direction the folded full-size sheet 5 and the half-size sheet 4 are conveyed.

The left side jogging plate 74 is positioned in a predetermined jogging position at an inner side part of the jogging table 57 in the initial state, and when the jogging rack 82 moves toward outside (in the arrow direction denoted by "Ou" in FIG. 13), the jogging plate pin 80 is moved, and thereby the left side jogging plate 74 is moved toward outside (in the arrow direction denoted by "Ou"). A sensor 83 is arranged at a reference position for movement and driving of the left side jogging plate 74 and the right side jogging plate 73 at an outer side part of the jogging table 57.

The right side jogging plate 73 having substantially the same configuration as that of the left side jogging plate 74 is arranged in the symmetrical position relative to the left side jogging plate 74, and is operated in the symmetrical manner relative to the left side jogging plate 74 by the right side jogging plate rack 160 engaged with the pinion integrated with the pulley 86 driven by the motor 88 as described above.

An end plate part jogs a folded full-size sheet 5 or half-size sheet 4 discharged onto the jogging table 57 with respect to front and rear sides thereof in the direction the folded full-size sheet 5 and half-size sheet 4 are conveyed, in cooperation with the position determining plate 60 of the binding position determining mechanism 201. The endplate part includes, as illustrated in FIG. 13, a pulley 92 including a motor 91 fixed to the rear plate 90 of the jogging table 57, a belt 93, a pulley pinion 94, a rear end jogging plate rack 96, an end plate position sensor 97, an end plate 95, etc. The end plate part operates in the forward and backward directions of the folded full-size sheet 5 and the half-size sheet 4 by rotation of the motor 91.

Figure 14:
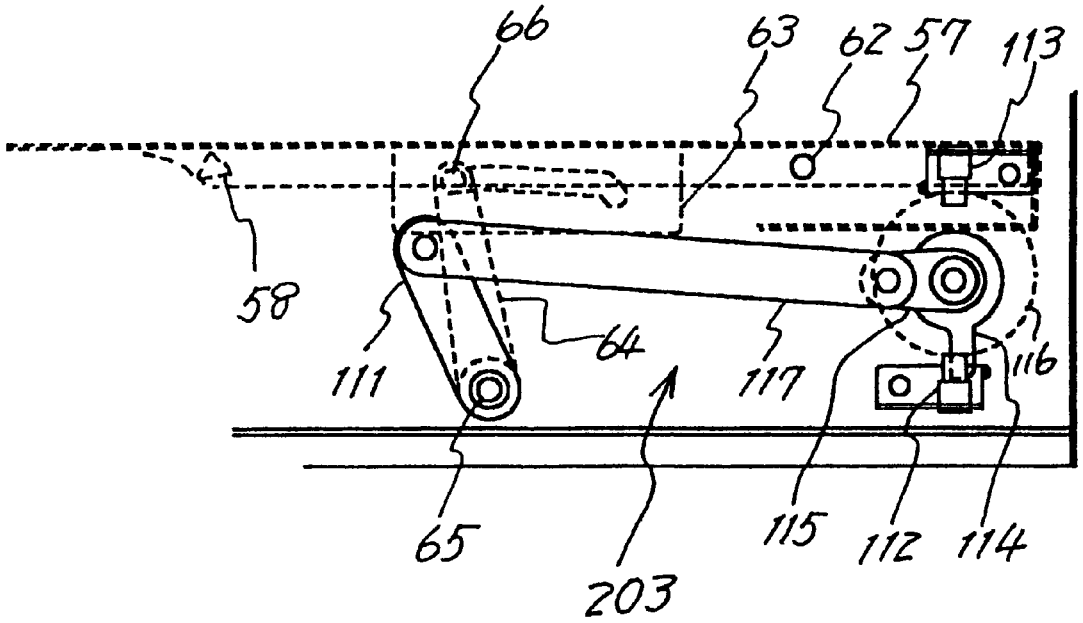
FIG. 14 is another schematic drawing illustrating the jogging table upward/downward moving mechanism.

FIG. 14 is another schematic drawing illustrating the jogging table upward/downward moving mechanism 203. The jogging table upward/downward moving mechanism 203 includes, as illustrated in FIG. 14 (and FIG. 11), a supporting axis 62 for mounting the jogging table 57 to both side plates of the main body so as to swing, and groove plates 63 integrally mounted to the side surfaces of the jogging table 57. Further, arms 64, each having a protrusion which is integral with the arm 64 and which engages with a groove hole of the groove plate 63 to move in the groove hole, and arms 111, which are rotatable relative to the side plates of the main body and arranged outside of the side plates, are fixed to an axis 65.

The jogging table upward/downward moving mechanism 203 further includes an arm 115 and an interrupting plate 114, which are fixed to and which rotate together with an axis of a motor 116 fixed to the side plate of the main body, and a link 117 connecting the arm 115 and the arm 111 with each other.

A sensor 113 and a sensor 112 are arranged so as to oppose each other via the axis of the motor 116. When the interrupting plate 114 rotates together with the axis of the motor 116, the interrupting plate 114 interrupts the sensor 113 and the sensor 112.

When the arm 115, integrated with the axis of the motor 116, rotates, the link 117 is reciprocally moved to swing the arm 111. When the arm 111 is in the left side end position illustrated in FIG. 14, the interrupting plate 114 interrupts the sensor 112, and when the arm 111 is in the right side end position illustrated in FIG. 11, the interrupting plate 114 interrupts the sensor 113.

Figure 15:
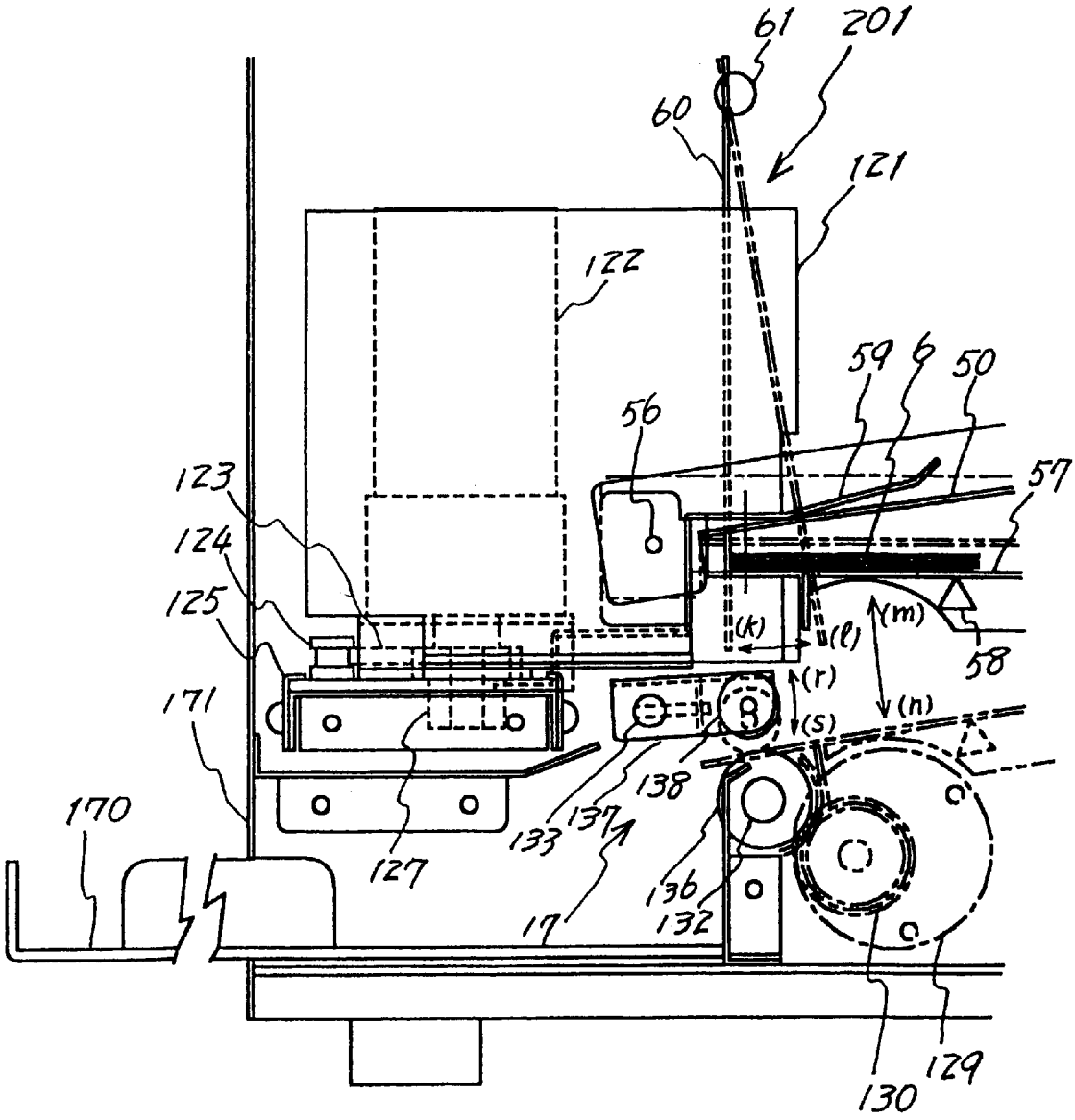
FIG. 15 is a cross section illustrating the binding part and the stack discharging part of the sheet folding and binding apparatus.

FIG. 15 is a cross section illustrating the binding part 16 and the stack discharging part 17 of the binding apparatus 3. The stapling part 16 includes, as illustrated in FIG. 15 (and in FIG. 12), the stapler 121 which is integrated with a rack 123 and an interrupting plate 120, a guide 125 and a guide 126 which guide the stapler 121 to predetermined (u) position and (v) position on the stapling table 128, a rack 123 which engages with a pinion 127 fixed to an axis of a motor 122, a rack guide 124 which guides the pinion 127 and the rack 123, and a sensor 140 and a sensor 141 which detect the positions of the stapler 121 so as to stop the stapler 121 at the predetermined positions (u) and (v).

The stack discharging part 17 includes, as illustrated in FIG. 15 (and in FIG. 12 and FIG. 11), a gear 130 which is fixed to an axis of motor 129 fixed to the side plate of the main body, a gear 131 engaging with the gear 130 and integrated with an axis of a roller 136, an axis 133 rotatably supported by the side plate of the main body, and a roller 138 which is rotatably supported by a discharging plate 137 fixed to the axis 133. Further, an arm 134 integrated with the axis 133 is arranged outside of the side plate, as illustrated in FIG. 11. The arm 134 is always pulled by a spring 109 in the counterclockwise direction to be stopped by a stopper 135 at its home position. A spring 110 is attached to the arm 134, at the side opposite the side the spring 109 is attached, to be connected with a solenoid 102.

The exit part 18 includes, as illustrated in FIG. 3, an opening part 171 opened toward the rear side (toward left in figure) of the binding apparatus 3 and an exit table 170.

The operation part 20 includes as illustrated in FIG. 3 a display 20*b* and a reset button 20*a*.

Now, an operation of the image forming and binding system according to an embodiment of the present invention is described.

Figure 16A:
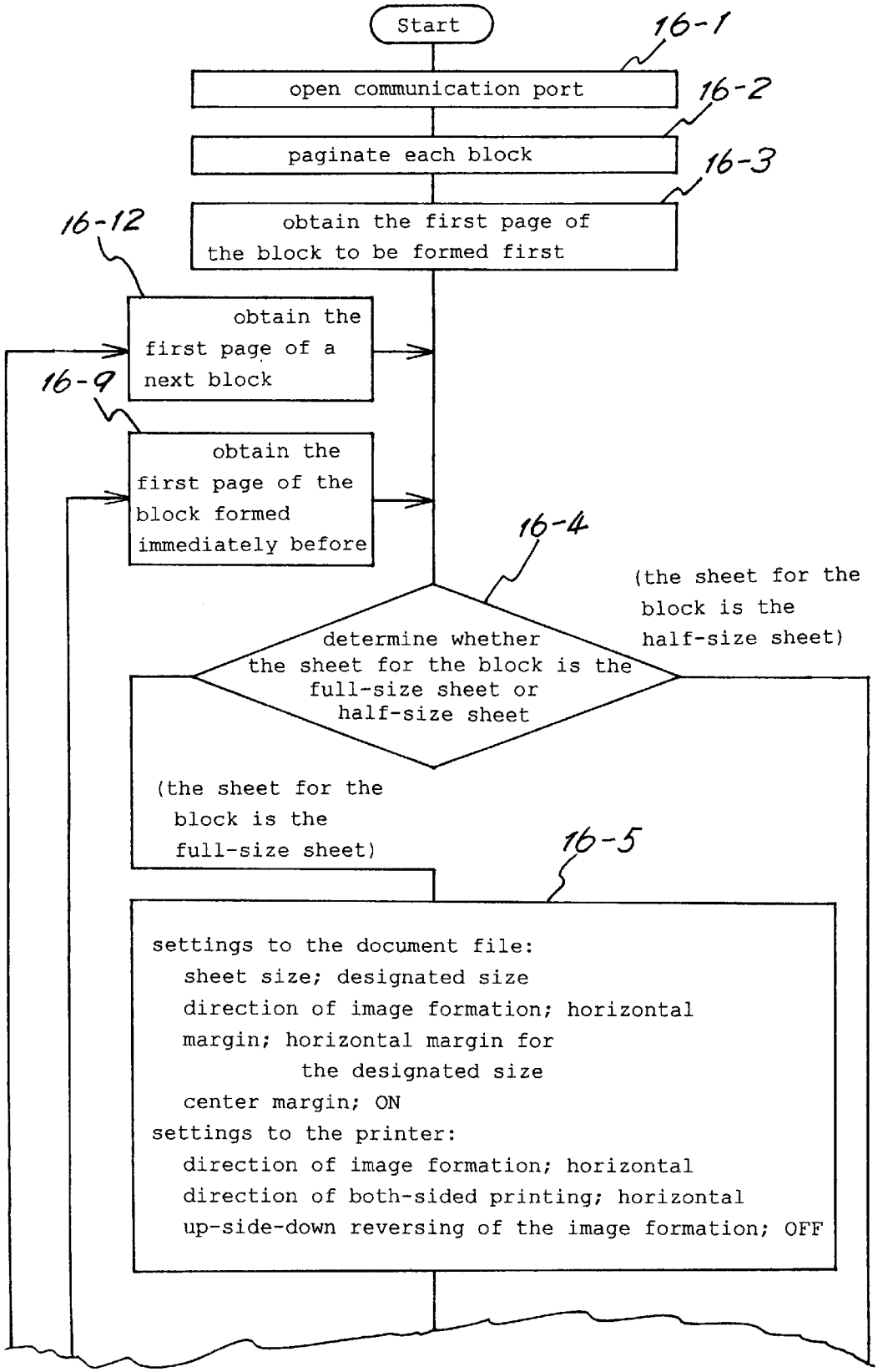
FIGS. 16A–16C are a flowchart illustrating an exemplary procedure of forming images of a document file on sheets by the printer of the system under control of the PC of the system.
Figure 16B:
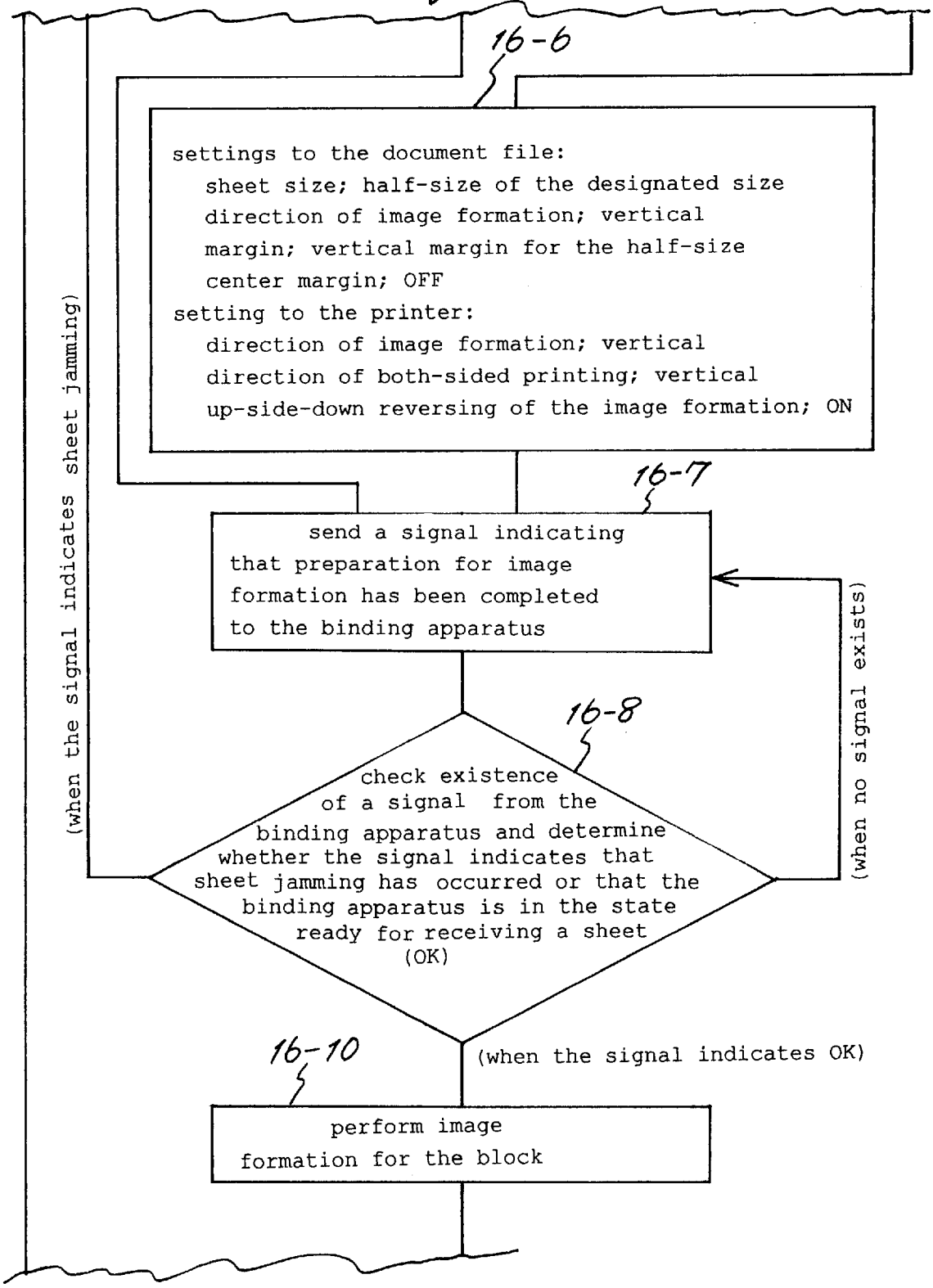
Figure 16C:
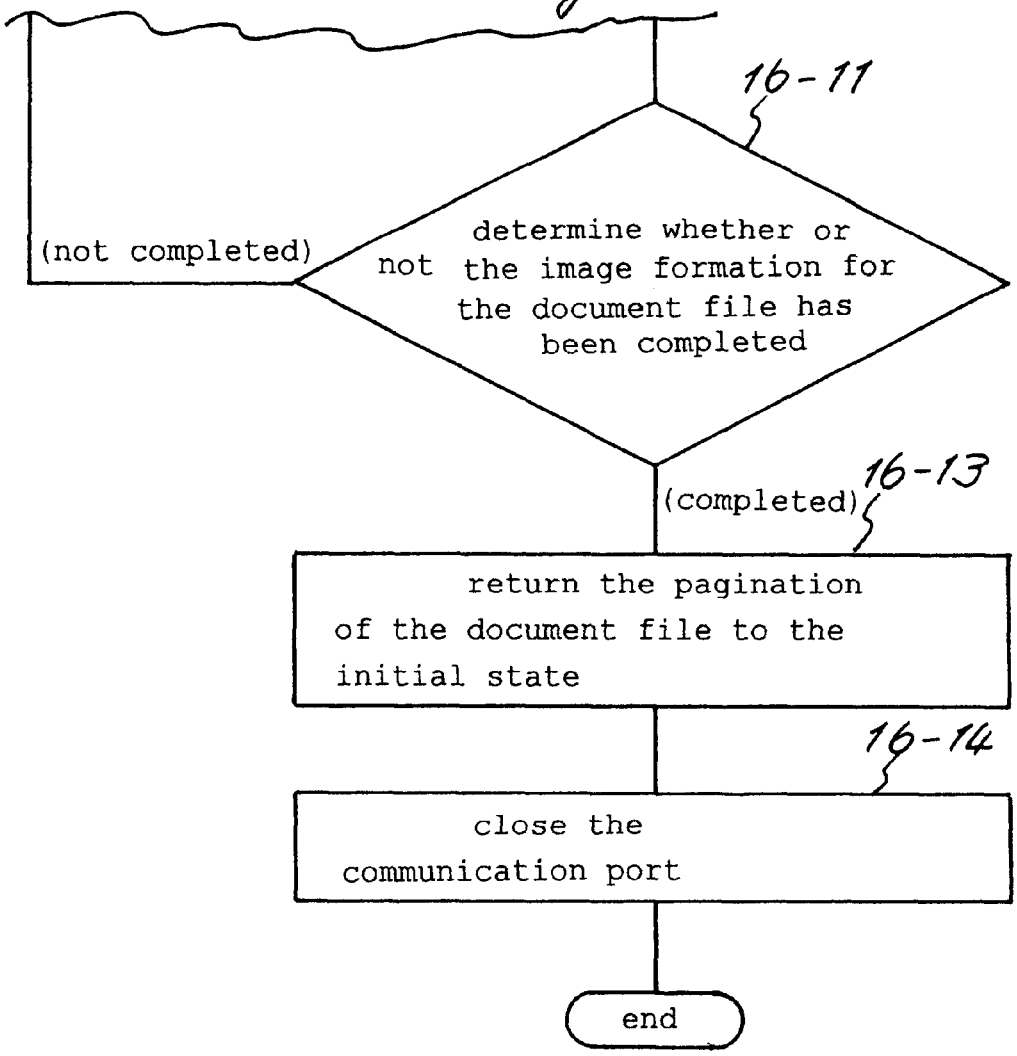

FIGS. 16A–16C illustrate an exemplary procedure of forming images of a document file created by or stored in the PC 1 on sheets by the printer 2 under control of the PC 1.

First, at the PC 1, after selecting the document file, when the user inputs an instruction for both-sided printing, the PC 1 displays on its display the number of total pages of the document file, messages requesting designation of the size of a printing sheet for the document file, designation of the page for inserting a half-size sheet half the size of the printing sheet when the number of total pages of the document file is not a multiple number of 4, and specification as to whether to start forming the images of the document file with the last page or with the first page of the document file. Then, after designating the size of the printing sheet for the document file to one of those of A3 and B4 size sheets set to be conveyed in their longitudinal direction, designating the page for inserting the half-size sheet (when the number of total pages of the document file is not a multiple number of 4), and inputting the specification as to whether to start forming the images of the document file with the last page or with the first page of the document file, when the user inputs an instruction for starting the printing, the operation of forming the images of the document file is started.

In step 16-1, the PC 1 opens its communication port for communicating with the controller 19 of the binding apparatus 3. The PC 1 and the controller 19 of the binding apparatus 3 are connected with each other by the RS232C interface for exchanging signals.

In the image forming and sheet binding system of the present invention, the PC 1 controls the printer 2 to form images of four pages of a document file on a full-size sheet (for example, an A3 or B4 size sheet) conveyed in its longitudinal direction such that in order of image formation at the printer 2, an image of a fourth page of the four pages and an image of a first page of the four pages are on an upper side and an image of a second page of the four pages and an image of a third page of the four pages are on a back side of the full-size sheet, and images for two pages of the document file on a half-size sheet half the size of the full-size sheet (for example, an A4 or B5 size sheet) conveyed in its lateral direction such that in order of image formation at the printer 2, an image of a first page of the two pages is on an upper side and an image of a second page of the two pages is on aback side of the half-size sheet. Hereinafter, such four pages or two pages of a document file, the images of which are to be formed on one sheet, are referred to as a block of the document file.

In step 16-2, pagination for each block of the document file is performed. For example, when the number of total pages of the document file is 10 and the page for inserting the half-size sheet is designated, for example, to p5, the first block of the document file is paginated as [p4, p1, p2, p3], the second block as [p5, p6] and the third block as [p10, p7, p8, p9], respectively in order of image formation at the printer 2. The pages enclosed in the symbol [ ] constitute one block.

In step 16-3, the first page of the block to be formed first at the printer 2 is obtained. The block to be formed first is determined according to the inputted specification as to whether to start forming the images of the document file with the last page or with the first page of the document. When the specification has been made such that forming the images of the document file starts with the last page of the document file for example, the block including the last page is determined as the block to be formed first. Whether to start forming the images of a document file with the last page or the first page of the document file depends on the configuration of the binding part 16. When the binding part 16 is configured to staple the stacked sheets from above, the specification should be made such that forming the images of the document file starts with the last page, and when the stapling part 16 is configured to staple the stacked sheets from below, the specification should be made such that forming the images of the document file starts with the first page of the document file. The specification as to whether to start forming the images of a document file with the last page or the first page of the document file may be preset according to the configuration of the binding part 16.

In step 16-4, whether the sheet for the block to be formed first is the full-size sheet set to be conveyed in its longitudinal direction or the half-size sheet half the size of the full-size sheet and set to be conveyed in its lateral direction is determined.

When the sheet for the block to be formed first is determined as the full-size sheet, in step 16-5 settings for the full-size sheet are made to the document file and the printer 2. The settings to the document file includes, for example, setting of the size of the printing sheet to the designated size (for example, that of the A3 or B4 size sheet set to be conveyed in its longitudinal direction), setting of the direction of image formation to a horizontal (landscape) direction, setting of the margin for the printing sheet to a horizontal margin for the designated size of the printing sheet, and setting of a center margin to be ON. The settings to the printer 2 includes, for example, setting of the direction of image formation to a horizontal (landscape) direction, setting of the direction of both-sided printing to a horizontal (landscape) direction, and setting of up-and-down reversing of the image formation to be OFF.

When the sheet for the first block is determined as the half-size sheet, in step 16-6, settings for the half-size sheet are made to the document file and the printer 2. The settings to the document file include, for example, setting of the size of the printing sheet to the half-size of the designated size (for example, to that of the A4 or B5 size sheet set to be conveyed in its lateral direction), setting of the direction of image formation to a vertical (portrait) direction, setting of the margin for the printing sheet to a vertical margin for the half-size sheet, and setting of a center margin to be OFF. The settings to the printer 2 include, for example, setting of the direction of image formation to a vertical (portrait) direction, setting of the direction of both-sided printing to a vertical (portrait) direction, and setting of up-and-down reversing of the image formation to be ON.

In step 16-7, a signal indicating that preparation for image formation has been completed is sent to the controller 19 of the binding apparatus 3.

In step 16-8, existence of a signal from the controller 19 of the binding apparatus 3 is checked. If the signal exists, whether the signal indicates that a sheet jamming has occurred at the binding apparatus 3 or that the binding apparatus 3 is in the state ready for receiving a sheet is determined.

If no signal exists in step 16-8, the operation returns to step 16-7 to send again the signal indicating that preparation for image formation has been completed to the controller 19 of the binding apparatus 3.

If the signal from the controller 19 of the binding apparatus 3 indicates that a sheet jamming has occurred at the binding apparatus 3, in step 16-9, the first page of the block formed immediately before is obtained, and the operations of steps 16-4, 16-5 or 16-6, and 16-7 are performed for the block again.

If the signal from the controller 19 of the binding apparatus 3 indicates that the binding apparatus 3 is in the state ready for receiving a sheet, in step 16-10, the images of the pages of the current block are formed by the printer 2.

In step 16-11, whether or not the image formation for the document file has been completed, i.e., whether or not a remaining block of the document file exists, is determined.

If the remaining block exists, in step 16-12, the first page of a next block of the document is obtained, and then the processes of steps 16-4 through 16-11 are repeated.

If no remaining block exists, in step 16-13, the pagination of each block of the document file returns to the initial state.

Then, in step 16-14, the communication port of the PC 1 is closed, and the image formation for the document file at the printer 2 ends.

Figure 17A:
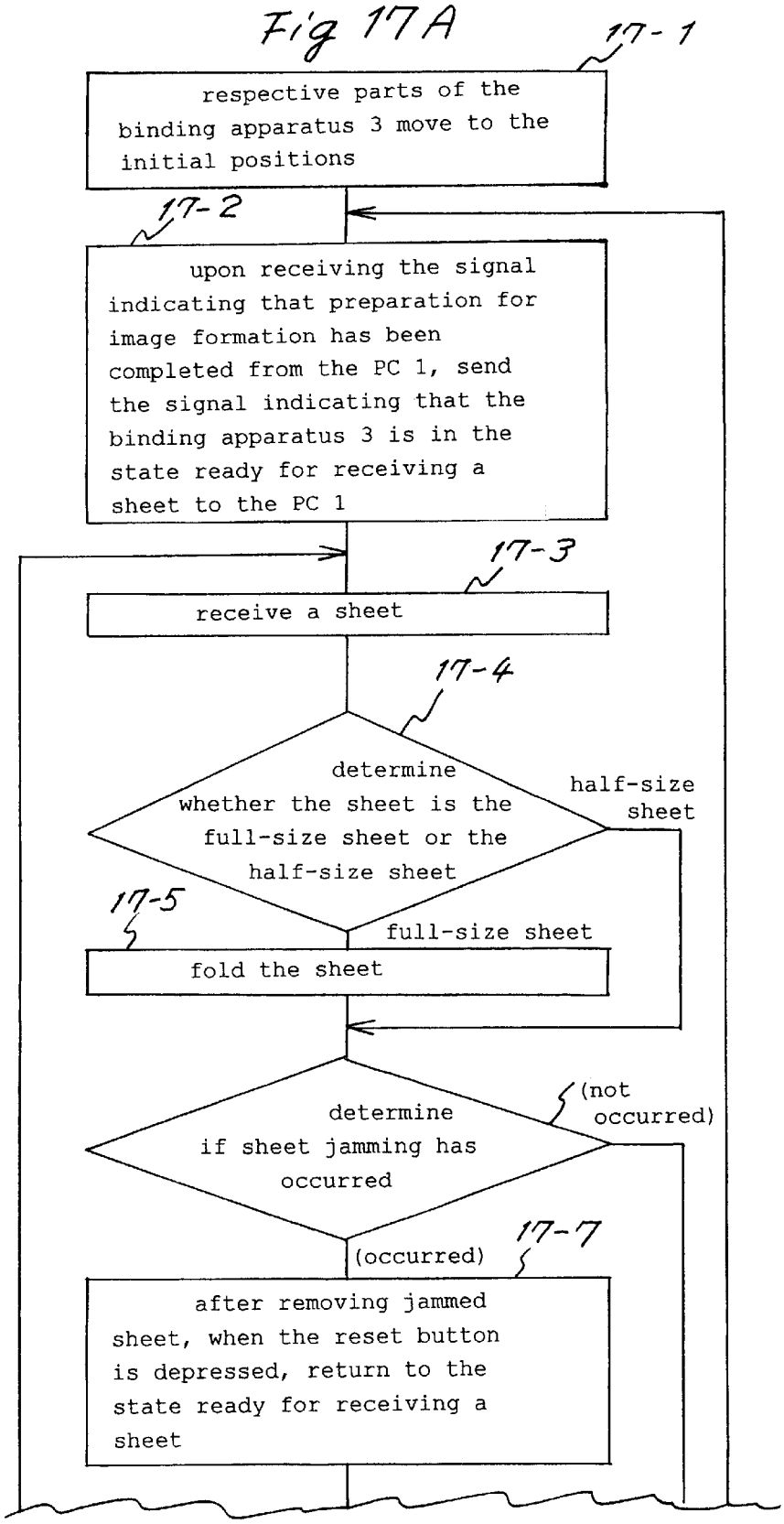
FIGS. 17A and 17B are a flowchart illustrating an exemplary operation of the sheet folding and binding apparatus.
Figure 17B:
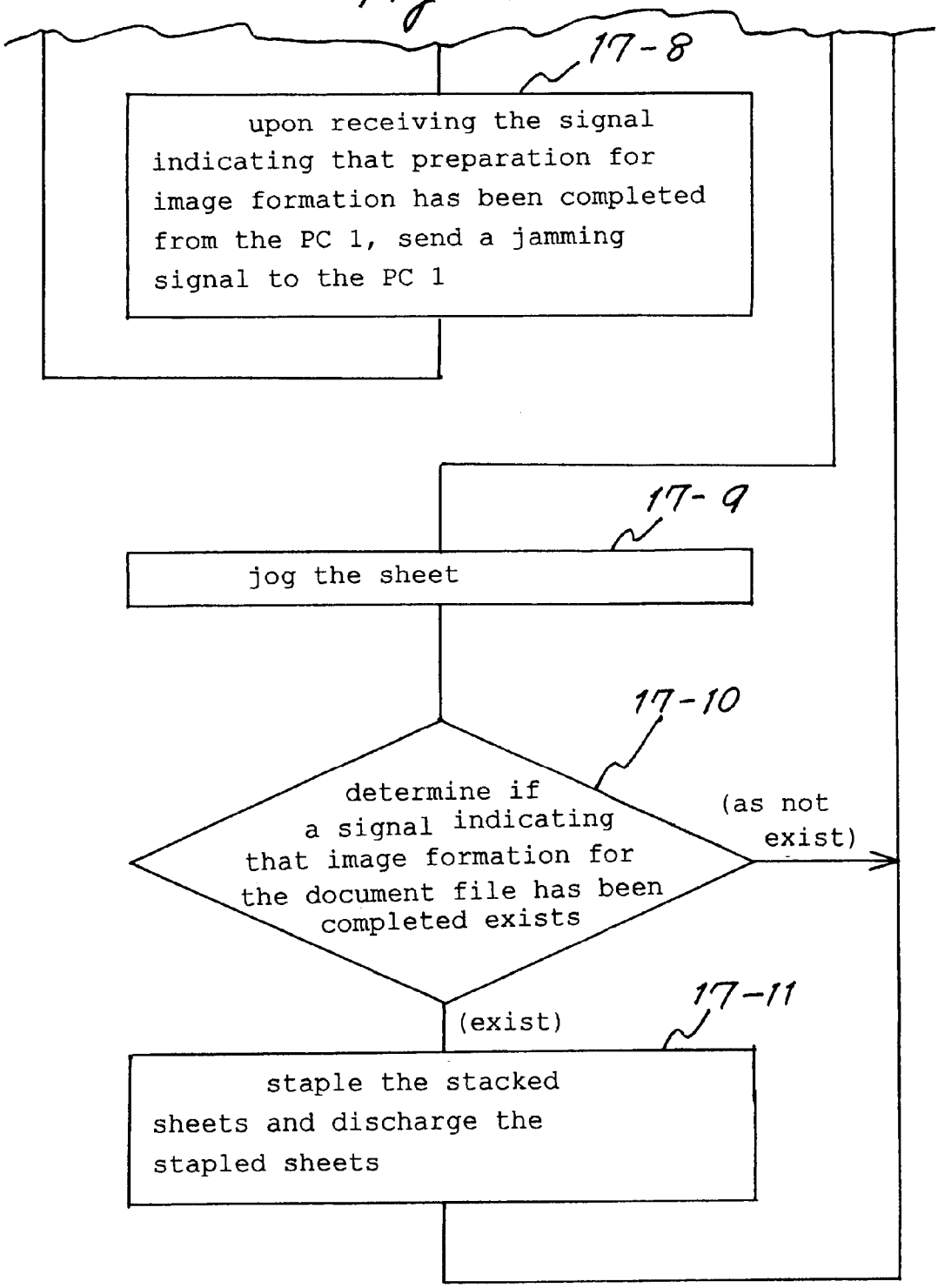
Figure 18A:
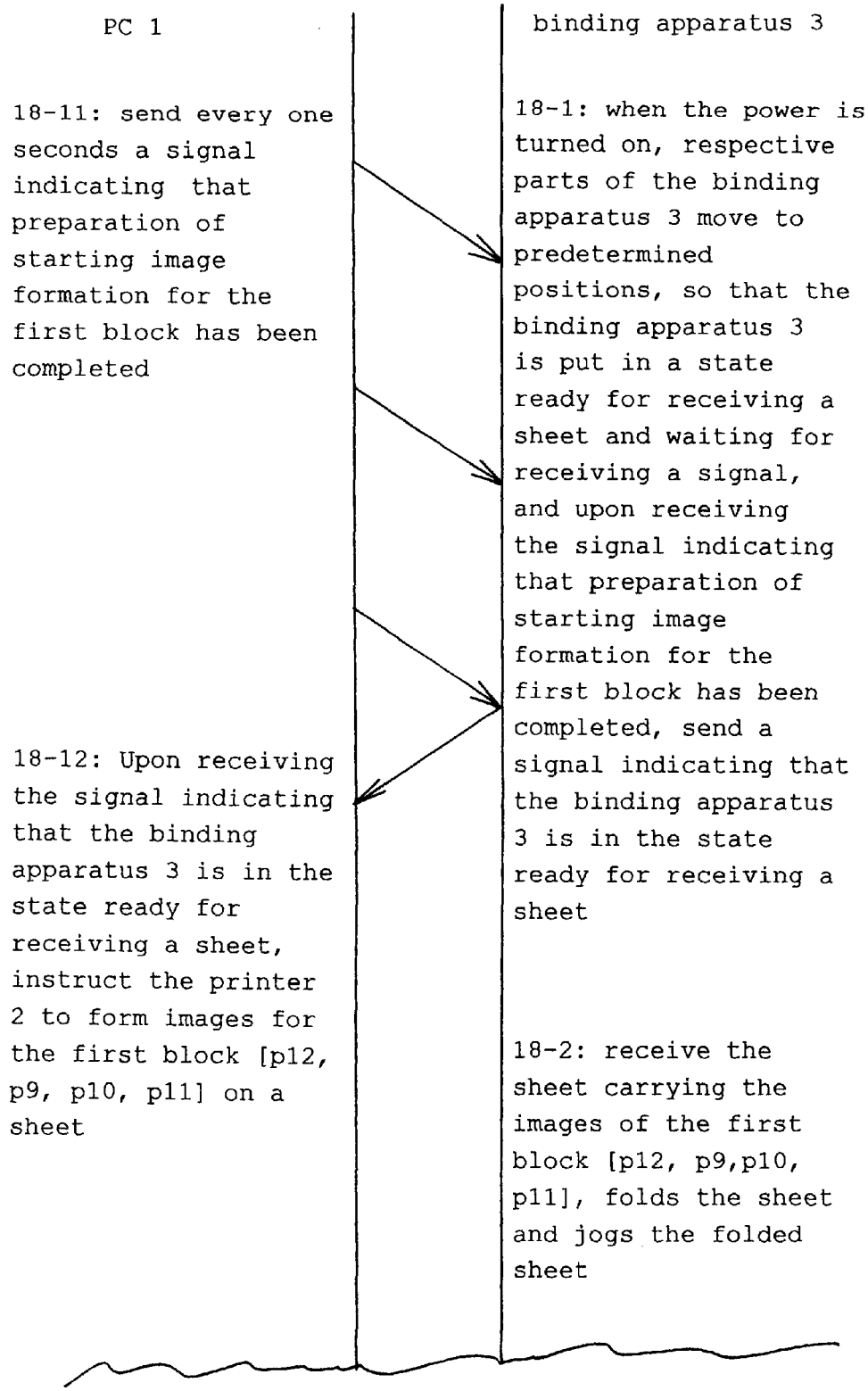
Figure 18D:
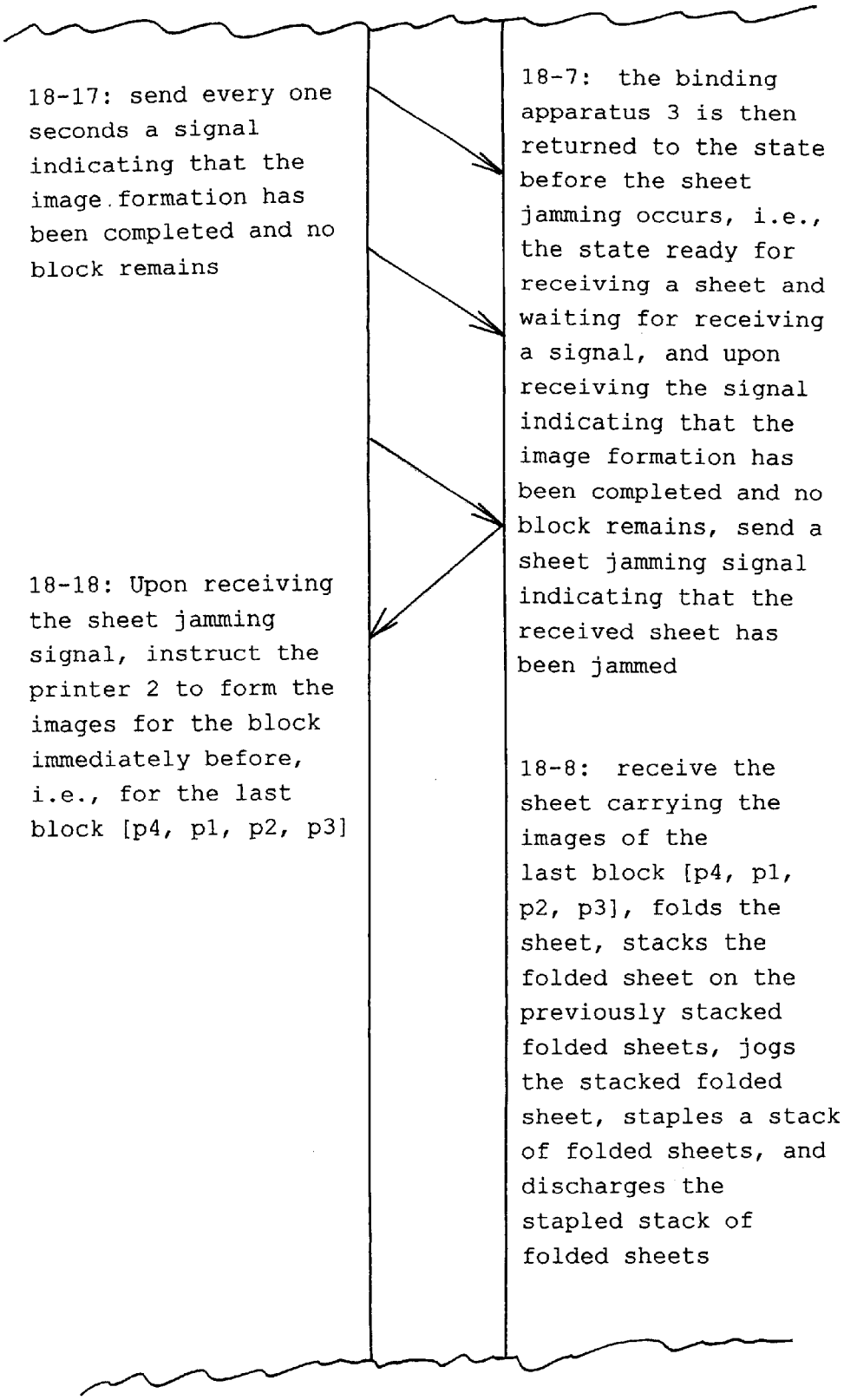
Figure 18E:
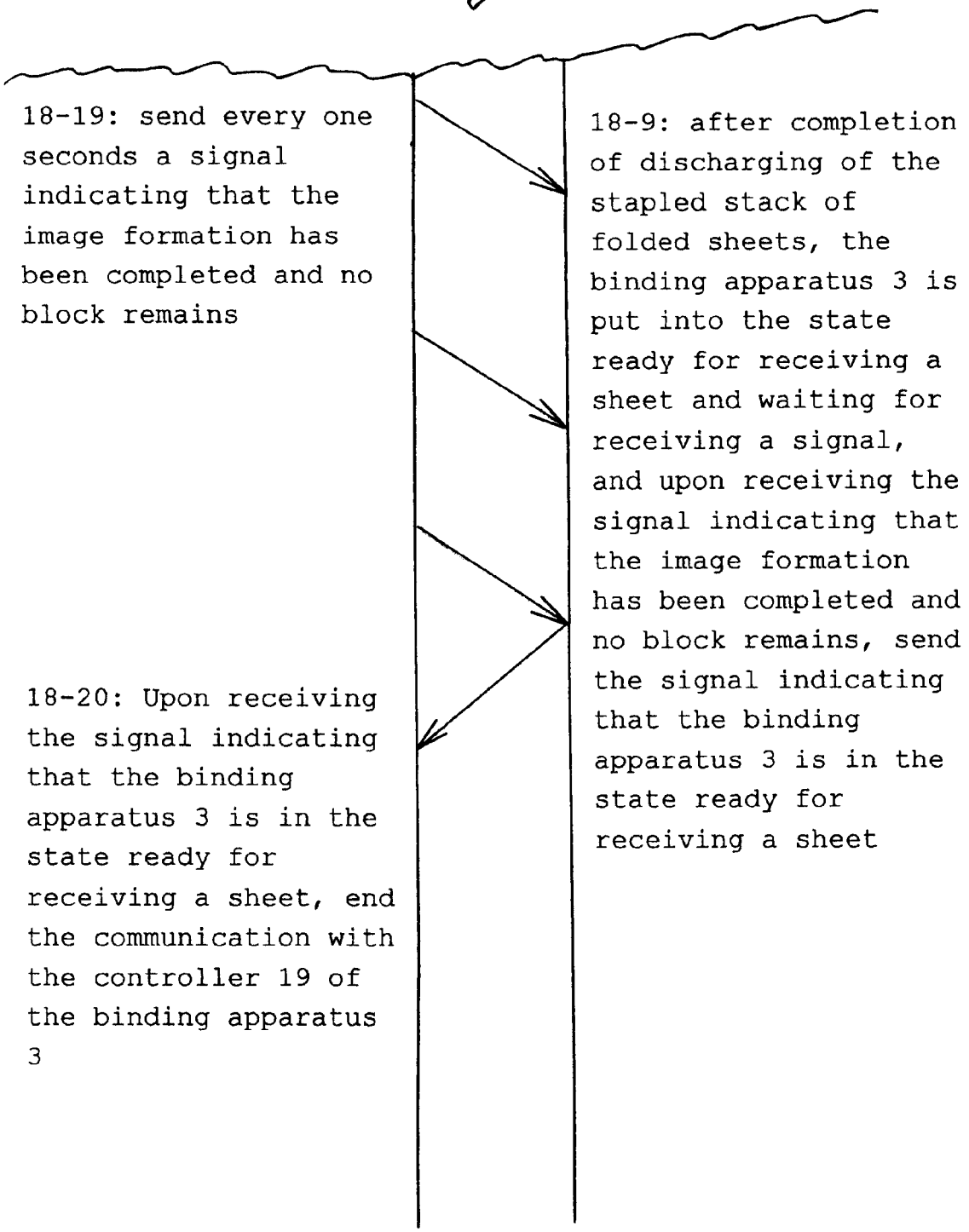

Next, an operation of the binding apparatus 3 is described referring to FIGS. 17A and 17B.

When the power of the binding apparatus 3 is turned on, respective parts of the binding apparatus 3 move to their initial positions to be prepared for receiving a sheet 4 (step 17-1), and the controller 19 of the binding apparatus 3 is put into a state ready for receiving a sheet and waiting for a signal indicating that preparation for starting the operation of image formation has been completed from the PC 1, and upon receiving the signal from the PC 1, the controller 9 sends to the PC 1 the signal indicating that the binding apparatus 3 is in the state ready for receiving a sheet and so that the printer 2 may start the image formation (step 17-2). The controller 19 is also put into the same state, when an operation of stacking and jogging an intermediate sheet at a predetermined position is completed (step 17-9), or when an operation of stapling a stack of sheets and discharging the stapled stack is completed (step 17-11).

On the other hand, as described above, after the settings to the document file and the printer 2 have been completed, the PC 1 sends the signal indicating that preparation for starting the operation of image formation for the document file has been completed to the controller 19 of the binding apparatus 3. When the PC 1 receives the signal indicating that the binding apparatus 3 is in the state ready for receiving a sheet and so that the printer 2 may start the operation of image formation from the controller 19 of the binding apparatus 3, the PC 1 starts the operation of image formation.

The controller 19 of the binding apparatus 3 memorizes whether the signal from the PC 1 is either for the last block or an intermediate block of the document file, to determine, after the sheet for the block is stacked and jogged, whether to staple a stack of sheets and discharge the stack of sheets or to wait for a next sheet.

The description is now made with respect to an operation of the mechanism of the binding apparatus 3. When the power of the binding apparatus 3 is turned on, respective parts of the binding apparatus 3 prepare for receiving a sheet 4 to be conveyed from the printer 2. As illustrated in FIG. 10, the knife unit 35 is in the (a) position, the center sheet thrusting plate 50 is in the (e) position, the position determining plate 60 is in the (k) position, the roller 138 is in the (r) position, and the jogging table 57 is in the (m) position with the interrupting plate 114 interrupting the sensor 112 and with the arm 64 positioning in the (p) position.

Further, the left side jogging plate 74 and the right side jogging plate 73 on the jogging table 57 move, by rotation of the motor 88 in the clockwise direction, from the outer positions toward the center part of the jogging plate 57 to the predetermined jogging positions. The jogging positions are set for each of the folded full-size sheets 5 such as the A3 and B4 size sheets that are conveyed in their longitudinal direction and that are folded in two at respective center portions in the longitudinal direction thereof.

The end plate 95 moves to the position to interrupt the end plate position sensor 97. The stapler 121 waits for the folded full-size sheet 5 and the half-size sheet 4 at the position (u) where the interrupting plate 120 interrupts the sensor 140.

When the sheet 4 discharged from the printer 2 reaches the entrance part 11 of the binding apparatus 3 to be conveyed by the conveying belt 305 and detected by the tip end sensor 303, the entrance roller 33, the sheet folding roller pairs 42 of the sheet folding part 13 and the slanting rollers 302 of the sheet shifting mechanism of the entrance part 11 start to rotate (step 17-3). The sheet 4 is conveyed along the reference guide 306, while the position of the sheet 4 is being corrected (so that the sheet 4 is folded at a right angle in the direction the sheet 4 is conveyed, when the sheet 4 is a full-size sheet conveyed in its longitudinal direction) to be conveyed into the entrance roller 33 and the sheet folding roller pair 42.

As described above, the distance between the tip end sensor 303 and the intermediate sensor 301 of the entrance part 11 is made to be about 20 mm longer than the length of a half-size sheet of the A3 full-size sheet (i.e., an A4 size sheet), conveyed in the lateral direction thereof, in the direction the half-size sheet is conveyed. Therefore, while the A3 full-size sheet conveyed in the longitudinal direction thereof is detected by both of the tip end sensor 303 and the intermediate sensor 301 at the same time, the half size sheet of the A3 full-size sheet (the A4 size sheet), conveyed in the lateral direction thereof, is not detected by both of the sensors 303 and 301 at the same time. Thus, whether the sheet 4 conveyed from the printer 2 is the A3 full-size sheet conveyed in its longitudinal direction or the half-size sheet of the A3 size sheet (the A4 size sheet), conveyed in its lateral direction, is determined (step 17-4).

When the conveyed sheet 4 is detected to be the A3 full-size sheet 4 for example, the A3 full-size sheet is folded in two (step 17-5). When the conveyed sheet 4 is detected to be the half-size sheet 4, the half-size sheet 4 is not folded.

When the conveyed sheet 4 is detected to be the half-size sheet, according to an instruction from the controller 19 based on the detect result, the solenoid 47 is operated before the half-size sheet 4 is conveyed into between the entrance roller 33 and the sheet folding roller pair 42 to move the knife unit 35 to the lower position (b) illustrated in FIG. 10, so that the half-size sheet 4 is guided by the conveying guide 225 of the knife unit 35 toward the sheet folding roller pair 42 located downward of the entrance roller 33. Thus, the half-size sheet 4 is conveyed by the sheet folding roller pair 42 without being folded. When a tip end of the half-size sheet 4 reaches the sheet sensor 44, the solenoid 47 is released, so that the knife unit 35 moves to the upper position (a).

When the conveyed sheet 4 is detected to be the full-size sheet, the knife unit 35 is not operated and stays in the upper position (a) illustrated in FIG. 10. Thereby, the full-size sheet 4 is conveyed to the sheet guiding part 12. The full-size sheet 4 conveyed to the sheet guiding part 12 is conveyed between the lower guide plate 37 and the upper guide plate 36 of the sheet guiding part 12, the tip end sensor 39 detects a tip end of the full-size sheet 4, and sends a detect signal to the controller 19, and after a predetermined period of time the solenoid 47 is operated to move the knife unit 35 in the clockwise direction.

On the other hand, after the tip end of the full-size sheet 4 is detected by the tip end sensor 39, the full-size sheet 4 is stopped by the sheet stopper 40. At this time, because the entrance roller 33 and the sheet folding roller pair 42 continue to rotate, a portion of the full-size sheet 4 out of the lower guide plate 37 and the upper guide plate 36 slackens.

Accordingly, the slackened center portion of the full-size sheet 4 is pushed by the knife unit 35 downwardly toward the sheet folding roller pair 42, so that the pushed center portion of the full-size sheet 4 is pinched by the sheet folding roller pair and is put into between the sheet folding roller pair 42, and thereby the full-size sheet 4 is folded by the folding roller pair 42. The full-size sheet 4 can be folded without use of a knife unit mechanism, however, by using the knife unit 35, the preciseness in folding the full-size sheet 4 at the center portion thereof is increased and unsatisfactory folding of the full-size sheet 4 can be reduced.

The folded full-size sheet 4 (folded sheet 5) conveyed by the sheet folding roller pair 42 or the half-size sheet 4 guided by the conveying guide 225 of the knife unit 35 without being folded is further conveyed into between the supplemental pressing roller pair 45 to be further pressed and conveyed to be discharged, after passing the sheet sensor 44, onto the jogging table 57.

When the folded sheet 5 or the half-size sheet 4 is discharged onto the jogging table 57, the left side jogging plate 74 and the right side jogging plate 73 are in the predetermined jogging positions for jogging the folded sheet 5 and the half-size sheet 4 at the center of the jogging table 57, and the end plate 95 is in the outermost position to interrupt the end plate position sensor 97.

After the sheet sensor 44 detects passage of the folded sheet 5 or the half-size sheet 4, thereby determining as that no sheet jamming has occurred (NO in step 17-6), a predetermined period of time later, the solenoid 55 operates to rotate the arm 54, the axis 53 and the arm 52, which are integrated with each other, around the axis 53 in the clockwise direction, so that the sheet center thrusting plate 50 rotates around the axis 56 to the (f) position to thrust the folded sheet 5 or the half-size sheet 4 to the jogging table 57 so as to be substantially in the horizontal position.

Thereafter, the left side jogging plate 74 and the right side jogging plate 73 move to the outer side positions, so that the left side jogging plate 74 interrupts the left side position sensor 83. When the left side position sensor 83 is interrupted by the left side jogging plate 74, the motor 88 starts to rotate in the reverse direction, so that the left side jogging plate 74 and the right side jogging plate 73 return to the predetermined jogging positions to jog the folded sheet 5 and the half-size sheet 4. Further, the end plate 95 at the position interrupting the end plate position sensor 97 is moved by rotation of the motor 91 to the predetermined jogging position to jog the folded sheet 5 or the half-size sheet 4. Thus, the folded sheet 5 or the half-size sheet 4 is jogged (step 17-9).

Thereafter, the solenoid 55 is released and the sheet center thrusting plate 50 returns to the upper position (e) At the same time, the end plate 95 returns to the position to interrupt the end plate position sensor 97.

When the PC 1 completes the image formation for the last block of the document file, the PC 1 sends to the controller 19 of the binding apparatus 3 a signal indicating that the image formation for the document file has been completed and no block remains. Therefore, after the sheet sensor 44 detects the passage of the folded full-size sheet 5 or the half-size sheet 4 and the left side jogging plate 74 and the right side jogging plate 73 complete movement to the predetermined jogging positions, the controller 19 checks if the signal indicating that the image formation for the document file has been completed (i.e. no block remains) exists (step 17-10). If the signal does not exist, the operation returns to step 17-2.

The binding apparatus 3 receives a next sheet 4, and when the sheet 4 is detected to be the full-size sheet, folds the full-size sheet 4 at the center portion thereof in the sheet conveying direction to be a next folded sheet 5, and the folded sheet 5 is discharged from the supplemental pressing roller pair 45 on the previously conveyed folded sheet 5 on the jogging table 57. After the sheet sensor 44 detects passage of the folded sheet 5, a predetermined period of time later, the sheet center thrusting plate 50 rotates to the horizontal position (f) to thrust the folded sheet 5, and further the left side jogging plate 74, the right side jogging plate 73 and the end plate 95 respectively move to jog the folded sheet 5. When the sheet center thrusting plate 50 rotates upwardly, at the same time the end plate 95 moves back (toward outside) to stop at the position interrupting the end plate position sensor 97 to wait there for a next folded sheet 5. Thus, folded sheets 5 are conveyed one after another, the sheet center thrusting plate 50 thrusts the folded sheets 5 from above, and the left side jogging plate 74, the right side plate 73 and the end plate 95 jog the folded sheets 5.

If the sheet sensor 44 does not start detection of passage of the half-size sheet 4 or the folded sheet 5 within a predetermined time after a leading edge of the received sheet 4 has been detected by the tip end sensor 303, or when the sheet sensor 44 has started the detection, if the sheet sensor 44 does not complete the detection within a predetermined period of time after starting the detection, the controller 19 determines as that the received sheet 4 has been jammed, and generates a sheet jamming signal indicating that the received sheet 4 has been jammed, and at the same time displays a sheet jamming indication at the display 20*b* of the operation part 20 of the binding apparatus 3 (YES in step 17-6). After removing the jammed received sheet 4, when the reset button 20*a* of the operation part 20 is depressed, the controller 19 of the binding apparatus 3 is put into the state ready for receiving a sheet and waiting for a signal indicating that preparation for starting the operation of image formation has been completed from the PC 1 (step 17-7), and upon receiving from the PC 1 the signal indicating that preparation for image formation has been completed, the jamming signal is sent to the PC 1 (step 17-8), so that the PC 1 controls the printer 2 to form the images of the preceding block, which have been formed immediately before.

After the last folded sheet 5 or half-size sheet 4 is discharged onto the previously stacked folded sheets 5 and the half-size sheets 4 on the jogging table 57, if the signal indicating that the image formation for the document file has been completed (i.e., no block remains) exists (YES in step 17-10), the sheet center thrusting plate 50 thrusts the last folded sheet 5 or half-size sheet 4 from above, the left side jogging plate 74, the right side jogging plate 73 and the end plate 95 jog the last folded sheet 5 or half-size sheet 4 at the predetermined positions, the stapler 121 staples the stacked folded sheets 5 and half-size sheets 4 on the jogging table 57, and the stapled folded sheets 5 and half-size sheets are discharged (step 17-11). The stapler 121 staples the stacked folded sheets 5 and half-size sheets 4 at their leading edges portions in the direction the folded sheets 5 and the half-size sheets 4 have been conveyed onto the jogging table 57 at the (u) position, and thereafter the motor 122 starts to rotate in the clockwise direction to move the rack 121, so that the stapler 121 is moved from the (u) position to the (v) position where the interrupting plate 120 of the stapler 121 interrupts the sensor 141, and staples the stacked folded sheets 5 and half-size sheets 4 at the (v) position. The stapler 12-1 is then returned to the (u) position.

Upon completion of stapling the stacked folded sheets 5 and half-size sheets 4 by the stapler 121 at the (v) position, the sheet center thrusting plate 50 is returned to the (e) position, and the end plate 95 on the jogging table 57 starts to move outwardly and stops after moving a predetermined distance. At the same time, the solenoid 102 is turned on, so that the position determining plate 60 moves from the (k) position to the (l) position to thereby push out a stapled booklet 6 from the opening part of the stapler 121.

The motor 116 rotates in the clockwise direction until the interrupting plate 114 interrupts the sensor 113, so that the jogging table 57 rotates around the axis 62 from the (m) position to the (n) position, and then the motor 129 starts to rotate to rotate the roller 113, and at the same time the end plate 95 on the jogging table 57 moves toward the center of the jogging table 57, so that the booklet 6 is pushed toward the booklet discharging part 17. When the booklet 6 is moved by a predetermined distance, the solenoid 102 is operated so that the roller 138 presses the booklet 6 to the roller 136, and the booklet 6 is discharged onto the discharging table 140 by the roller 136.

The sensor 58 detects that the booklet 6 has been discharged from the jogging table 57, and thereby a stapling operation is completed and preparation for receiving a next sheet 4 is started.

Now, referring to FIGS. 18A–18E, exemplary communication between the PC 1 controlling the printer 2 and the controller 19 of the binding apparatus 3 according to an embodiment of the present invention is described.

In this embodiment, the pagination of a document file is controlled by the PC 1, and further image formation at the printer 2 is controlled such that image formation for a next sheet is performed at the printer 2 after folding of a previous sheet and jogging of the folded sheet is completed at the binding apparatus 3, as described above. Thereby, unnecessary image formation at the printer 2 is avoided, and at the same time, jamming of a plurality of sheets is avoided and thereby jammed sheet clearing at the binding apparatus 3 is facilitated.

More specifically, when the printer 2 is configured to perform image formation for a document file independently from the binding apparatus 3, if a preceding sheet conveyed from the printer 2 to the binding apparatus 3 is jammed at the binding apparatus 3, subsequent sheets conveyed from the printer 2 are also jammed at the binding apparatus 3. This causes not only increasing useless image formation at the printer 2, but also increasing the time for clearing jammed sheets at the binding apparatus 3, and as a result, the time for completing a booklet. By controlling the printer 2 such that image formation for a next sheet will not be performed at the printer 2 until folding of a previous sheet and jogging of the folded sheet is completed at the binding apparatus 3, useless image formation at the printer 2 is avoided and at the same time jamming of a plurality of sheets is avoided from occurring and thereby jammed sheet clearing at the binding apparatus 3 is facilitated.

FIG. 18 illustrates a case of producing a booklet of a document file of 12 pages constituted of 3 blocks. In FIG. 18, the operations of the PC 1 and the binding apparatus 3 in response to received signals are also described.

After completing the pagination of the document file, the PC 1 sends every one seconds a signal indicating that preparation of starting image formation for the first block has been completed to the controller 19 of the binding apparatus 3 (step 18-11). On the other hand, when the power of the binding apparatus 3 is turned on, respective parts of the binding apparatus 3 move to predetermined positions, so that the binding apparatus 3 is put in a state ready for receiving a sheet, and upon receiving the signal indicating that preparation of starting image formation for the first block has been completed, being sent from the PC 1 every one seconds, the controller 19 of the binding apparatus 3 sends to the PC 1 a signal indicating that the binding apparatus 3 is in the state ready for receiving a sheet (step 18-1).

Upon receiving from the controller 19 the signal indicating that the binding apparatus 3 is in the state ready for receiving a sheet, the PC 1 instructs the printer 2 to form images for the first block [p12, p9, p10, p11] on a sheet (step 18-12).

Thereafter, the PC 1 sends every one seconds the signal indicating that preparation of starting image formation for the second block has been completed to the controller 19 of the binding apparatus 3 (step 18-13).

On the other hand, the binding apparatus 3 receives the sheet carrying the images of the first block [p12, p9, p10, p11] sent from the printer 2, folds the sheet and jogs the folded sheet (step 18-2). After completion of jogging of the folded sheet, the binding apparatus 3 is put into the state ready for receiving a next sheet and waiting for receiving a signal, and upon receiving the signal indicating that preparation of starting image formation for the second block has been completed, being sent from the PC 1 every one seconds, the controller 19 sends to the PC 1 the signal indicating that the binding apparatus 3 is in the state ready for receiving a sheet (step 18-3).

Upon receiving from the controller 19 the signal indicating that the binding apparatus 3 is in the state ready for receiving a sheet, the PC 1 instructs the printer 2 to form images for the second block [p8, p5, p6, p7] on a sheet (step 18-14).

Thereafter, the PC 1 sends every one seconds the signal indicating that preparation of starting image formation for the third block (last block) has been completed to the controller 19 of the binding apparatus 3 (step 18-15).

On the other hand, the binding apparatus 3 receives the sheet carrying the images of the second block [p8, p5, p6, p7], folds the sheet, stacks the folded sheet on the previously conveyed folded sheet and jogs the stacked folded sheet (step 18-4). After completion of jogging of the folded sheet, the binding apparatus 3 is put into the state ready for receiving a next sheet and waiting for receiving a signal, and upon receiving the signal indicating that preparation for forming images for the last block has been completed, being sent from the PC 1 every one seconds, the controller 19 sends to the PC 1 the signal indicating that the binding apparatus 3 is in the state ready for receiving a next sheet (step 18-5).

Upon receiving from the controller 19 the signal indicating that the binding apparatus 3 is in the state ready for receiving a sheet, the PC 1 instructs the printer 2 to form images for the last block [p4, p1, p2, p3] on a next sheet (step 18-16).

Thereafter, the PC 1 sends to the controller 19 every one seconds a signal indicating that the image formation for the document file has been completed and no block remains (step 18-17).

On the other hand, the binding apparatus 3 receives the sheet carrying the images of the last block [p4, p1, p2, p3], and in this example, the received sheet is jammed, the jammed sheet is removed, and the reset button 20*a* is depressed (step 18-6). The binding apparatus 3 is then returned to the state before the sheet jamming occurs, i.e., the state ready for receiving a sheet and waiting for receiving a signal, and upon receiving the signal indicating that the image formation for the document file has been completed and no block remains, being sent from the PC 1 every one seconds, the controller 19 sends to the PC 1 a sheet jamming signal indicating that the received sheet has been jammed (step 18-7).

Upon receiving the sheet jamming signal from the controller 19 of the binding apparatus 3, the PC 1 instructs the printer 2 to form the images for the block immediately before, i.e., for the last block [p4, p1, p2, p3] (step 18—18).

Thereafter, the PC 1 sends to the controller 19 every one seconds a signal indicating that the image formation for the document file has been completed and no block remains (step 18-19).

On the other hand, the binding apparatus 3 receives the sheet carrying the images of the last block [p4, p1, p2, p3], folds the sheet, stacks the folded sheet on the previously stacked folded sheets, jogs the stacked folded sheet, staples a stack of folded sheets, and discharges the stapled stack of folded sheets (step 18-8). After completion of discharging of the stapled stack of folded sheets, the binding apparatus 3 is put into the state ready for receiving a sheet and waiting for receiving a signal, and upon receiving from the PC 1 the signal indicating that the image formation for the document file has been completed and no block remains, the controller 19 sends to the PC 1 the signal indicating that the binding apparatus 3 is in the state ready for receiving a sheet (step 18-9).

Upon receiving the signal indicating that the binding apparatus 3 is in the state ready for receiving a sheet from the controller 19 of the binding apparatus 3, the PC 1 ends the communication with the controller 19 of the binding apparatus 3 (step 18-20).

As described above, in the image forming and sheet binding system for producing a booklet of a document file according to the preferred embodiments of the present invention, a full-size sheet (such as an A3 or B4 size sheet) conveyed in the longitudinal direction thereof and carrying images of two pages of the document file on each side thereof is folded in two at its center portion in the longitudinal direction thereof, so that the folded full-size sheet is stacked one upon another to be bound at its folded side edge portion, and a half-size sheet half the size of the full-size sheet (such as an A4 or B5 size sheet) conveyed in its lateral direction and carrying an image of one page of the document file on each side thereof is stacked, without being folded, while being mixed with the folded full-size sheet.

Accordingly, the problem that 3 or 2 blank pages are inevitably produced in the booklet when the number of pages of the document file is a multiple number of 4 added by 1 or 2 and when only full-size sheets (such as A3 or B4 size sheets) conveyed in their longitudinal directions are used for producing the booklet is avoided by inserting the half-size sheet half the size of the full-size sheet (A4 or B5 size sheet) conveyed in its lateral direction.

Further, the page for inserting such a half-size sheet can be specified to any page of the document file, such as for example to the first page (the front cover page) or the last page (the rear cover page) of the document file, or otherwise to any intermediate page of the document file. Accordingly, by using a special paper for the half-size sheet and specifying the page for inserting the half-size sheet, for example, to the first page of the document file, the front cover of the booklet is made by the special paper, so that the quality of the booklet is increased. Further, when a color image is included in a certain page of the document file, by using a special paper for the half-size sheet suitable for forming the color image and specifying the page for inserting the half-size sheet to such a page, the color image is formed on the special paper, so that the quality of the booklet is increased.

Furthermore, the controller 19 of the binding apparatus 3 sends to the PC 1 the signal indicating that the binding apparatus 3 is in the state ready for receiving a sheet after the sheet sensor 44 completes the detection of passage of the folded sheet 5 or the half-size sheet 4 within the predetermined period of time after starting the detection, and the left side jogging plate 74 and the right side jogging plate 73 complete movement to the predetermined jogging positions and thereby complete jogging of the folded full-size sheet 5 or the half-size sheet 4 at the predetermined jogging positions, and the PC 1 instructs the printer 2 to start image formation for a next sheet upon receiving the signal from the controller 19. That is, the printer 2 is controlled such that image formation for a next sheet will not be performed at the printer 2 until folding of a previous sheet and jogging of the folded sheet is completed at the binding apparatus 3.

Accordingly, useless image formation at the printer 2 is avoided, and at the same time jamming of a plurality of sheets is avoided from occurring and thereby jammed sheet clearing at the binding apparatus 3 is facilitated.

Furthermore, when the received sheet 4 is jammed, after the jammed sheet 4 is removed and the reset button 20*a* of the operation part 20 is depressed, upon receiving from the PC 1 the signal indicating that preparation for image formation has been completed, the controller 19 sends the jamming signal to the PC 1, so that the PC 1 controls the printer 2 to form again the images for the block immediately before, i.e. the images which have been formed on the jammed sheet 4. Accordingly, even when a sheet jamming occurs, it is not necessary for the user to specify the block or page of the document file with which the printer 2 starts forming the images of the document file again, which is convenient.

Numerous additional modifications and variations of the present invention are possible in light of the above teachings. It is therefore to be understood that within the scope of the appended claims, the present invention may be practiced otherwise than as specifically described herein.

The present application claims priority and contains subject matter related to Japanese Patent Application No. 2001-292801 filed in the Japanese Patent Office on Sep. 26, 2001, and the entire contents of which are hereby incorporated by reference.

What is claimed as new and is desired to be secured by Letter Patent of the United States is:

1. An image forming and binding system for producing a booklet of a document file, comprising:

an image forming apparatus including a sheet feeding device configured to feed a full-size sheet set to be conveyed in its longitudinal direction and a half-size sheet half a size of the full-size sheet and set to be conveyed in its lateral direction, and configured to form images on both sides of the full-size sheet or the half-size sheet fed by the sheet feeding device and to discharge the sheet;

an image formation controller connected with the image forming apparatus and configured to control the image forming apparatus to form images of the document file on both sides of the full-size sheet and the half-size sheet fed by the sheet feeding device one by one, the image formation controller controlling the image forming apparatus to form images of four pages of the document file on each full-size sheet fed by the sheet feeding device such that images of two pages of the four pages are on each side of the full-size sheet and images of two pages of the document file on each half-size sheet fed by the sheet feeding device such that an image of one page of the two pages is on each side of the half-size sheet; and a sheet folding and binding apparatus including, a sheet receiving device configured to receive the sheet discharged from the image forming apparatus and to further convey the received sheet, the sheet receiving device including a sheet size detect device configured to detect if the received sheet is the full-size sheet conveyed in its longitudinal direction or the half-size sheet conveyed in its lateral direction, a folding device configured to fold the received sheet conveyed by the sheet receiving device in two at its center portion in a direction the received sheet is conveyed by the sheet receiving device, when the received sheet has been detected by the sheet size detect device to be the full-size sheet conveyed in its longitudinal direction, and to further convey the folded received sheet with the folded center portion thereof being served as a leading edge of the folded received sheet, the folding device conveying the received sheet conveyed by the sheet receiving device without folding the received sheet, when the received sheet has been detected by the sheet size detect device to be the half-size sheet conveyed in its lateral direction, a jogging device configured to receive and jog the received sheet conveyed by the folding device, one after another, so as to be stacked one upon another; and a binding device configured to bind the stacked received sheets at their leading edge portions in a direction the received sheets have been conveyed by the folding device and to discharge the bound stacked sheets as the booklet.

2. The image forming and binding system according to claim 1, wherein the sheet feeding device of the image forming apparatus is configured to feed a plurality of full-size sheets different in sizes and set to be conveyed in their longitudinal directions and a plurality of half-size sheets respectively half sizes of the plurality of full-size sheets and set to be conveyed in their lateral directions, wherein the image formation controller is configured to designate one of the plurality of full-size sheets as the full-size sheet for forming the images of four pages of the document file thereupon, wherein the sheet size detect device of the sheet receiving device of the sheet folding and binding apparatus is configured to detect a size of the received sheet, wherein the folding device of the sheet folding and binding apparatus includes a guiding mechanism configured to receive, guide and stop the received sheet conveyed by the sheet receiving device at a predetermined position according to the size of the received sheet detected by the sheet size detect device, when the received sheet has been detected by the sheet size detect device to be the full-size sheet conveyed in its longitudinal direction, and a sheet pushing mechanism configured to push the received sheet guided and stopped by the guiding mechanism downward at its center portion in the direction the received sheet is conveyed by the sheet receiving device, and a sheet folding/pressing device configured to pinch the received sheet at the center portion thereof pushed by the sheet pushing mechanism so that the received sheet is folded at the center portion thereof by the sheet folding/pressing device and the folded received sheet is further conveyed with the folded center portion thereof being served as the leading edge of the folded received sheet, the sheet pushing mechanism guiding the received sheet conveyed by the sheet receiving device, when the received sheet has been detected by the sheet size detect device to be the half-size sheet conveyed in its lateral direction, so as to be further conveyed by the sheet folding/pressing device without being folded by the sheet folding/pressing device, and wherein the jogging device is configured to receive and jog the received sheet conveyed by the folding device, one after another, at a predetermined position in the jogging device according to the size of the received sheet detected by the sheet size detect device, so that the received sheet is stacked one upon another at the predetermined position.

3. The image forming and binding system according to claim 2, wherein the sheet receiving device of the sheet folding and binding apparatus includes a correcting mechanism configured to correct an advancing direction of the received sheet so as to be at a right angle relative to a longitudinal direction of the sheet folding/pressing device of the folding device.

4. The image forming and binding system according to claim 3, wherein the correcting mechanism of the sheet receiving device of the sheet folding and binding apparatus includes a reference guide configured to guide the advancing direction of the received sheet to be at the right angle relative to the longitudinal direction of the sheet folding/pressing device, and a sheet shifting device configured to shift the received sheet, while conveying the received sheet, to the reference guide so that the advancing direction of the received sheet is corrected by the reference guide so as to be at the right angle relative to the longitudinal direction of the sheet folding/pressing device.

5. The image forming and binding system according to claim 1, wherein the jogging device of the sheet folding and binding apparatus includes a movable device configured to move to a predetermined position to jog the received sheet conveyed by the folding device one after another with respect to left and right sides thereof in a direction the received sheet is conveyed by the folding device, wherein the sheet folding and binding apparatus includes a controller configured to determine if the movable device has completed its movement to the predetermined position and to generate a signal indicating that the movable device has completed its movement to the predetermined position when determined as that the movable device has completed its movement to the predetermined position, and wherein the image formation controller is configured to control the image forming apparatus to start an image forming operation for a next sheet after receiving from the controller of the sheet folding and binding apparatus the signal indicating that the movable device of the jogging device has completed its movement to the predetermined position.

6. The image forming and binding system according to claim 1, wherein the sheet folding and binding apparatus further includes, a detect sensor arranged between the folding device and the jogging device to detect passage of the received sheet, and a controller configured to determine that the received sheet has been jammed and to generate a sheet jamming signal indicating that the received sheet has been jammed if detection of the passage of the received sheet by the detect sensor is not started within a predetermined period of time after a leading edge of the received sheet has been detected by the sheet size detect device of the sheet receiving device, or when the detection of the passage of the received sheet by the detect sensor has started, if the detection is not completed within a predetermined period of time after the detection has been started.

7. The image forming and binding system according to claim 6, wherein the image formation controller is configured to control the image forming apparatus, when controlling the image forming apparatus to perform an image forming operation after receiving from the controller of the sheet folding and binding apparatus the sheet jamming signal indicating that the received sheet has been jammed, to perform the image formation operation starting with images of pages of the document file formed immediately before.

8. The image forming and binding system according to claim 1, wherein the sheet folding and binding apparatus includes a controller configured to determine whether or not the folding device, the jogging device and the binding device are respective states ready for receiving a next sheet, and to generate a signal indicating that the folding device, the jogging device and the binding device are in the respective states ready for receiving the next sheet when determined as that the folding device, the jogging device and the binding device are in the respective states ready for receiving the next sheet, and a sheet jamming signal indicating that the received sheet has been jammed when determined as that the folding device, the jogging device and the binding device are not in the respective states ready for receiving the next sheet, and wherein the image formation controller is configured to control the image forming apparatus, when the image forming apparatus is in a state ready for starting an image forming operation, to start the image forming operation upon receiving from the controller of the sheet folding and binding apparatus the signal indicating that the folding device, the jogging device and the binding device are in the respective states ready for receiving the next sheet.

9. The image forming and binding system according to claim 8, wherein the image formation controller is configured to control the image forming apparatus, when controlling the image forming apparatus to perform an image forming operation after receiving from the controller of the sheet folding and binding apparatus the sheet jamming signal indicating that the received sheet has been jammed, to perform the image forming operation starting with images of pages of the document file formed immediately before.

10. The image forming and binding system according to claim 1, wherein the image formation controller is configured to control the image forming apparatus to form the images of the document file on both sides of the full-size sheet and the half-size sheet that are fed by the sheet feeding device one by one so as to be mixed with each other.

11. The image forming and binding system according to claim 10, wherein the image formation controller is configured to control the image forming apparatus to form images of given two pages of the document file on each of a given number of the half-size sheets fed by the sheet feeding device so as to be mixed with the full-size sheet.

12. The image forming and binding system according to claim 1, wherein the image formation controller is configured to set a direction of forming the images of four pages of the document file on each full-size sheet to be lateral and a direction of forming the images of two page of the document file on each half-size sheet to be vertical, and to set upper, bottom, left and right side margins to the half-size sheet and bottom, left and right side margins and a center margin to the full-size sheet.

13. The image forming and binding system according to claim 1, wherein the image formation controller is configured to control the image forming apparatus to form the images of four pages of the document file on each full-size sheet such that in order of forming the images at the image forming apparatus, an image of a fourth page of the four pages and an image of a first page of the four pages are on an upper side and an image of a second page of the four pages and an image of a third page of the four pages are on a back side of the full-size sheet, and to form the images of two pages of the document file on each half-size sheet such that in order of image formation at the image forming apparatus an image of a first page of the two pages is on an upper side and an image of a second page of the two pages is on a back side of the half-size sheet.

14. A method of producing a booklet of a document file, comprising the steps of:

controlling an image forming apparatus including a sheet feeding device configured to feed a full-size sheet set to be conveyed in its longitudinal direction and a half-size sheet half a size of the full-size sheet and set to be conveyed in its lateral direction to form images of the document file on both sides of the full-size sheet or the half-size sheet fed by the sheet feeding device and to discharge the sheet by an image formation controller, the image formation controller controlling the image forming apparatus to form images of four pages of the document file on each full-size sheet fed by the sheet feeding device such that images of two pages of the four pages are on each side of the full-size sheet and images of two pages of the document file on each half-size sheet fed by the sheet feeding device such that an image of one page of the two pages is on each side of the half-size sheet;

receiving the sheet discharged from the image forming apparatus by a receiving device of a sheet folding and binding apparatus, detecting if the received sheet is the full-size sheet conveyed in its longitudinal direction or the half-size sheet conveyed in its lateral direction by a sheet size detect device of the receiving device, and further conveying the received sheet by the receiving device;

folding the received sheet conveyed by the receiving device in two at its center portion in a direction the received sheet is conveyed by the receiving device by a folding device of the sheet folding and binding apparatus and further conveying the folded received sheet with the folded center portion thereof being served as a leading edge thereof by the folding device, when the received sheet has been detected to be the full-size sheet conveyed in its longitudinal direction in the receiving step, and conveying the received sheet conveyed by the receiving device by the folding device without folding the received sheet, when the received sheet has been detected to be the half-size sheet conveyed in its lateral direction in the receiving step;

receiving and jogging the received sheet conveyed by the folding device, one after another, by a jogging device of the sheet folding and binding apparatus, so to be stacked one upon another; and binding the stacked received sheets by a binding device of the sheet folding and binding apparatus at their leading edge portions in a direction the received sheets have been conveyed by the folding device, and discharging the bound stacked sheets as the booklet.

15. The method according to claim 14, wherein the sheet feeding device of the image forming apparatus is configured to feed a plurality of full-size sheets different in sizes and set to be conveyed in their longitudinal directions and a plurality of half-size sheets respectively half sizes of the plurality of full-size sheets and set to be conveyed in their lateral directions, wherein the controlling step includes designating one of the plurality of full-size sheets different in sizes and set to be conveyed in their longitudinal directions as the full-size sheet for forming the images of four pages of the document file thereupon, wherein the receiving step includes detecting a size of the received sheet by the sheet size detect device, wherein the folding step includes when the received sheet has been detected to be the full-size sheet in the receiving step, receiving, guiding and stopping the received sheet by a guiding mechanism of the folding device at a predetermined position according to the size of the received sheet detected in the receiving step, pushing by a pushing mechanism of the folding device the received sheet stopped by the guiding mechanism downward at its center portion in the direction the received sheet is conveyed by the receiving device, and pinching the received sheet by a sheet folding/pressing device of the folding device at the center portion thereof pushed by the pushing mechanism so that the received sheet is folded at the center portion thereof by the sheet folding/pressing device and the folded received sheet is further conveyed with the folded center portion thereof being served as the leading edge of the folded received sheet, and when the received sheet has been detected to be the half-size sheet in the receiving step, guiding the received sheet by the pushing mechanism so as to be further conveyed by the sheet folding/pressing device without being folded by the sheet folding/pressing device, and wherein in the receiving and jogging step the received sheet conveyed by the sheet folding/pressing device is received and jogged one after another by the jogging device at a predetermined position in the jogging device according to the size of the received sheet detected in the receiving step, so as to be stacked one upon another at the predetermined position.

16. The method according to claim 15, wherein the receiving step includes correcting an advancing direction of the received sheet so as to be at a right angle relative to a longitudinal direction of the sheet folding/pressing device.

17. The method according to claim 16, wherein the correcting step includes shifting the received sheet to a reference guide so that the advancing direction of the sheet is corrected by the reference guide so as to be at the right angle relative to the longitudinal direction of the sheet folding/pressing device.

18. The method according to claim 14, wherein the receiving and jogging step includes moving a movable device of the jogging device to a predetermined position so that the received sheet conveyed by the folding device is jogged with respect to left and right sides thereof in a direction the received sheet has been conveyed by the folding device, and determining by a controller of the sheet folding and binding apparatus if the movable device has completed its movement to the predetermined position and generating a signal indicating that the movable device has completed its movement to the predetermined position when determined as that the movable device has completed its movement to the predetermined position, wherein the controlling step includes controlling the image forming apparatus to start an image forming operation for a next sheet after the image formation controller receives from the controller of the sheet folding and binding apparatus the signal indicating that the movable device of the jogging device has completed its movement to the predetermined position.

19. The method according to claim 14, further comprising the steps of:

detecting passage of the received sheet by a detect sensor arranged between the folding device and the jogging device; and determining as that the received sheet has been jammed and generating a sheet jamming signal indicating that the received sheet has been jammed by a controller of the sheet folding and binding apparatus if the detecting step is not started within a predetermined period of time after a leading edge of the received sheet has been detected by the sheet size detect device in the receiving step, or when the detecting step has started, if the detecting step is not completed within a predetermined period of time after starting the detecting step.

20. The method according to claim 19, wherein the controlling step includes controlling the image forming apparatus by the image formation controller, when controlling the image forming apparatus to perform an image forming operation after receiving from the controller of the sheet folding and binding apparatus the sheet jamming signal indicating that the received sheet has been jammed, to control the image forming apparatus to perform the image forming operation starting with images of pages of the document file formed immediately before.

21. The method according to claim 14, further comprising the step of:

determining whether or not the folding device, the jogging device and the binding device are respective states ready for receiving a next sheet, and generating a signal indicating that the folding device, the jogging device and the binding device are in the respective states ready for receiving the next sheet when determined as that the folding device, the jogging device and the binding device are respective states ready for receiving the next sheet and a sheet jamming signal indicating that the received sheet has been jammed when determined as that the folding device, the jogging device and the binding device are not in the respective states ready for receiving the next sheet, by a controller of the sheet folding and binding apparatus; and wherein the controlling step includes controlling the image forming apparatus by the image formation controller, when the image forming apparatus is in a state ready for starting an image forming operation, to start the image forming operation, upon receiving from the controller of the sheet folding and binding apparatus the signal indicating that the folding device, the jogging device and the binding device are in the respective states ready for receiving the next sheet.

22. The method according to claim 21, wherein the controlling step includes controlling the image forming apparatus by the image formation controller, when controlling the image forming apparatus to perform an image forming operation after receiving from the controller of the sheet folding and binding apparatus the sheet jamming signal indicating that the received sheet has been jammed, to perform the image forming operation starting with images of pages of the document file formed immediately before.

23. The method according to claim 14, wherein the controlling step includes controlling the image forming apparatus to form the images of the document file on both sides of the full-size sheet and the half-size sheet that are fed by the sheet feeding device so as to be mixed with each other.

24. The method according to claim 23, wherein the controlling step includes controlling the image forming apparatus to form images of given two pages of the document file on each of a given number of the half-size sheets fed by the sheet feeding device so as to be mixed with the full-size sheet.

25. The method according to claim 14, wherein the controlling step includes setting a direction of forming the images of four pages of the document file on each full-size sheet to be lateral and a direction of forming the images of two pages of the document file on each half-size sheet to be vertical, and setting upper, bottom, left and right side margins to the half-size sheet and bottom, left and right side margins and a center margin to the full-size sheet.

26. The method according to claim 14, wherein the controlling step includes controlling the image forming apparatus to form the images of four pages of the document file on each full-size sheet such that in order of forming the images at the image forming apparatus, an image of a fourth page of the four pages and an image of a first page of the four pages are on an upper side and an image of a second page of the four pages and an image of a third page of the four pages are on a back side of the full-size sheet, and to form the images of two pages of the document file on each half-size sheet such that in order of forming the images at the image forming apparatus an image of a first page of the two pages is on an upper side and an image of a second page of the two pages is on a back side of the half-size sheet.

* * * * *